US005240241A

United States Patent [19]

Kawazoe

[11] Patent Number: 5,240,241

[45] Date of Patent: Aug. 31, 1993

[54] SHEET FEEDING APPARATUS

[75] Inventor: Kenji Kawazoe, Yokohama, Japan

[73] Assignee: Canon Kabushiki Kaisha, Tokyo, Japan

[21] Appl. No.: 564

[22] Filed: Jan. 4, 1993

Related U.S. Application Data

[63] Continuation of Ser. No. 783,353, Oct. 28, 1991, abandoned.

[30] Foreign Application Priority Data

Oct. 31, 1990 [JP] Japan ..... 2-296725
Aug. 23, 1991 [JP] Japan ..... 3-237468

[51] Int. Cl.[5] ..... B65H 3/06

[52] U.S. Cl. ..... 271/114; 271/226; 271/242

[58] Field of Search ..... 271/114, 115, 226, 228, 271/242-244, 246

[56] References Cited

U.S. PATENT DOCUMENTS

| | | | |
|---|---|---|---|
| 4,645,192 | 2/1987 | Watanabe | 271/242 |
| 4,722,518 | 2/1988 | Watanabe | 271/242 |
| 4,754,961 | 7/1988 | Tokuda et al. | 271/114 |
| 4,799,662 | 1/1989 | Sagara et al. | 271/114 |
| 4,822,019 | 4/1989 | Nagira | 271/114 |
| 5,085,420 | 2/1992 | Sata | 271/242 |

FOREIGN PATENT DOCUMENTS

| | | | |
|---|---|---|---|
| 0228789 | 6/1987 | European Pat. Off. . | |
| 0279530 | 8/1988 | European Pat. Off. . | |
| 59-172344 | 9/1984 | Japan . | |
| 61-037451 | 2/1986 | Japan . | |
| 36258 | 2/1987 | Japan | 271/226 |
| 79151 | 4/1987 | Japan | 271/226 |
| 62-185649 | 8/1987 | Japan . | |
| 62-259944 | 11/1987 | Japan . | |
| 2055768 | 3/1981 | United Kingdom . | |

OTHER PUBLICATIONS

"Research Disclosure", Havant Great Britain, Disclosed Anonymously, 'Skew Correction Technique', n. 31566 (Jul. 1990).

*Primary Examiner*—Robert P. Olszewski
*Assistant Examiner*—Steven M. Reiss
*Attorney, Agent, or Firm*—Fitzpatrick, Cella, Harper & Scinto

[57] ABSTRACT

A sheet feeding apparatus having a sheet support for supporting sheets, a rotary sheet supply roller for feeding out the sheets stacked on the sheet support, a rotary feed roller for feeding the sheet in normal and reverse directions with respect to a sheet feeding direction, and a load set control for prohibiting a reverse rotation of the rotary sheet supply roller is disclosed. A skew-feed of the sheet is corrected by the feeding of the sheet in the reverse direction by use of the rotary feed roller and the load set control.

46 Claims, 15 Drawing Sheets

CLUTCH ON

CLUTCH OFF

SHEET FEEDING APPARATUS

This application is a continuation of application Ser. No. 07/783,353 filed Oct. 28, 1991, now abandoned.

BACKGROUND OF THE INVENTION

1. Field of the Invention

The present invention relates to a sheet feeding apparatus for feeding a sheet (copy sheet, transfer sheet, photosensitive sheet, electrostatic recording sheet, print sheet, OHP sheet, envelope, post card, sheet original or the like) placed on a sheet containing portion (sheet stacking platform, sheet stacking tray, sheet stacking deck, removable sheet supply cassette, manual sheet supply platform or the like) or a sheet manually supplied from the sheet containing portion one by one to a sheet treatment portion such as an image forming station, exposure station, treating station or the like in an image forming system such as a copying machine, facsimile and the like or a recording system (printer) acting as an information output equipment of a word processor, personal computer and the like.

2. Related Background Art

For conconvenience' sake, an example of a sheet feeding apparatus of a printer shown in FIG. 4 will be explained.

A sheet support plate (sheet guiding means) 6 acting as a sheet containing portion (sheet stacking means) is disposed so that a front end thereof is inclined downwardly. An urging plate (intermediate plate) 8 is disposed above an upper surface of the sheet support plate and is always floated from the upper surface of the plate 6 by a biasing force of a spring member 8*a*. Sheet separating pawls (sheet separating means) 7 are arranged at front corners of the sheet support plate for separating a single sheet from the other sheets. The sheets 5 (copy sheets or recording media) are stacked on the sheet support plate 6 so that leading ends of the sheets are regulated or locked by the separating pawls 7.

A sheet supply roller 9 acting as a sheet supply means serves to afford a feeding force to the sheets stacked on the plate 6 and comprises a shaft portion 9*a* and a roller portion 9*b* integrally formed with the shaft portion. An uppermost sheet on the sheet stack 5 stacked on the plate 6 is urged against the roller portion 6*a* of the sheet supply roller 9 by the urging plate 8 biased upwardly by means of the spring member 8*a*.

A sheet feed roller (sheet relay convey means) 16 is arranged ahead of the sheet support plate 6 in a sheet feeding direction and comprises a shaft portion 16*b* and a roller portion 16*a* integrally formed with the shaft portion.

A sheet guide plate 26 is disposed between the sheet support plate 6 and the sheet feed roller 16 so that a leading end thereof is inclined downwardly, which sheet guide plate serves to guide the sheet 5 below the sheet feed roller 16. The leading end portion of the sheet guide plate 26 is arcuated to conform with a lower half surface of the roller portion 16*a* of the sheet feed roller 16 and to extend to the left side of the sheet feed roller.

First and second pinch rollers 17A and 17B are urged against the lower portion of the sheet feed roller 16 by respective spring members (not shown) at two upstream and downstream points along the sheet feeding direction, respectively. These pinch rollers are contacted with the sheet feed roller 16 through openings 26*a* formed in the arcuated leading end portion of the sheet guide plate 26, respectively, and are driven by the rotational movement of the sheet feed roller 16.

A platen bar 15 is disposed tangentially to the sheet feed roller 16 in the vicinity of the latter at the left side thereof. A reciprocable carriage 11 can be reciprocally shifted in parallel with the platen bar 15 by means of a guide rail and a drive means (both not shown). A recording head 12 and an ink ribbon cassette 13 are mounted on the carriage 11, and the recording head 12 is opposed to the platen bar 15 with the interposition of an ink ribbon 14.

When the sheet supply roller 9 is rotated in a clockwise direction, the uppermost sheet on the sheet stack 5 stacked on the sheet support plate 6 is subjected to the sheet feeding force, with the result that the front corner portions of the uppermost sheet ride on the separating pawls 7 to be unlocked by the separating pawls, thus separating the uppermost sheet alone from the other sheets. The separated uppermost sheet is guided by the sheet guide plate 26 to reach a nip between the sheet feed roller 16 and the first pinch roller 17A.

The uppermost sheet 5 is fed by the sheet feed roller 16 and the first pinch roller 17A between the arcuated end portion of the guide plate 26 and the lower surface of the sheet feed roller 16, and then is fed by the sheet feed roller 16 and the second pinch roller 17B between the arcuated end portion of the guide plate 26 and the lower surface of the sheet feed roller 16, so that the leading end of the sheet enters into a space between the platen bar 15 and the ink ribbon 14.

When a predetermined amount of the sheet is entered into the space between the platen bar 15 and the ink ribbon 14, the rotational movement of the sheet feed roller 16 is changed to an intermittent rotational drive control wherein the sheet is fed by one printing line space, and the control of the reciprocal shifting movement of the carriage 11, head-down/head-up control of the recording head 12, the feed control of the ink ribbon 14 and the like are executed in co-relation with each other by means of a record control circuit (not shown), thus performing the recording operation with respect to the sheet 5 per one line.

In consideration of the cost-down of the apparatus, the actuation of the sheet supply roller 9 may be linked with the activation of the sheet feed roller 16 by means of a feed motor (not shown). In this case, a clutch is disposed between the sheet supply roller 9 and the feed motor to switch over the activation between the sheet supply roller and the sheet feed roller. It is a most simplified method that the switching of the clutch is effected by rotating the feed motor in a direction opposite to a normal direction in which the feed motor is rotated when the sheet is supplied.

In such a method, when the feed motor is rotated in the normal direction by a sheet supply start signal, a normal rotational force of the motor is transmitted to the sheet supply roller 9 through the clutch, so that the sheet supply roller 9 is rotated in a sheet feeding direction to separate and feed the uppermost sheet from the sheet stack 5. The sheet feed roller 16 is also rotated in the sheet feeding direction.

The leading end of the sheet 5 is sent to the nip between the sheet feed roller 16 and the first pinch roller 17A by the rotation of the sheet supply roller 9. When the sheet is sent by a predetermined length or distance after the leading of the sheet has just passed through the nip, the feed motor is switched to be rotated reversely.

The clutch connection between the feed motor and the sheet supply roller 9 is disengaged by the reverse rotation of the feed motor, thus stopping the sheet supply roller 9. The sheet feed roller 16 is rotated in a reverse direction Q opposite to the sheet feeding direction P, so that the sheet fed by the predetermined distance through the nip between the feed roller 16 and the first pinch roller 17A is fed back until the leading end of the sheet passes through the nip between the feed roller 16 and the first pinch roller 17A.

By feeding back the leading end of the sheet in this way, a bent loop (as shown by the solid line) is formed in a sheet portion between the stationary sheet supply roller 9 and the nip (between the feed roller 16 and the first pinch roller 17A) in opposition to the resiliency of the sheet.

By forming such bent loop in the sheet, the leading end of the sheet is urged against the nip between the feed roller 16 and the first pinch roller 17A due to the reaction force of the bent loop, with the result that any skew-feed of the sheet is corrected to register the leading edge of the sheet with a longitudinal direction of the feed roller 16.

Then, by rotating the feed motor in the normal direction again, the leading end of the sheet which was registered with the longitudinal direction of the feed roller 16 is re-entered into the nip between the sheet roller 16 rotating in the normal direction P and the first pinch roller 17A urged against the sheet feed roller, thus feeding the sheet 5 to the recording head 12 without skewing the sheet.

However, in such a sheet feeding apparatus, if a kind of sheets is changed or the resiliency of the sheet is increased due to the change in the temperature and/or humidity in the apparatus, when the sheet feed roller 16 is rotated in the reverse direction, the resiliency of the sheet portion between the reverse rotating feed roller 16 and the stationary sheet supply roller 9 may overcome the sheet feeding-back force generated by the reverse rotating feed roller 16.

In such a case, there arises a relative slipping movement between the leading end portion of the sheet pinched between the feed roller 16 and the first pinch roller 17A and the reverse rotating feed roller 16, thus preventing the sheet from being fed back. Consequently, the skew-feed of the sheet cannot be corrected (because the loop cannot be formed in the sheet portion) and the sheet is distorted or damaged by the relative slipping movement between the sheet and the reverse rotating feed roller 16.

Further, if the resiliency of the sheet is too strong or the sheet is skew-fed into the apparatus, there arose a problem that the bent loop formed in the sheet portion during the reverse rotation of the feed roller becomes non-uniform and/or the sheet is non-uniformly depressed between the feed roller 16 and the first pinch roller 17A, thus remaining the skew-fed condition of the sheet.

SUMMARY OF THE INVENTION

An object of the present invention is to provide a sheet feeding apparatus which can surely correct the skew-feed of a sheet regardless of the resiliency of the sheet and without damaging the sheet and properly feed the sheet.

According to the present invention, there is provided a sheet feeding apparatus comprising, a sheet supporting means for stacking and supporting sheets, a rotary sheet supply means for feeding out the sheets stacked on the sheet supporting means, a rotary feed means for feeding the sheet in normal and reverse directions by pinching the sheet into a nip of the rotary feed means, and load set means for restricting rotation of said rotary sheet supply means by the sheet when load applied to said rotary sheet supply means in the reverse rotation direction from the sheet fed by said rotary feed means in the reverse direction is smaller than predetermined value, and for applying brake load to the rotary sheet supply means so that it is rotated by the sheet when the load in reverse rotation direction from the sheet is larger than the predetermined value, wherein skew-feed of the sheet is corrected by the sheet being fed in the reverse direction by said rotary feed means to said rotary sheet supply means to which a brake load is applied by said load set means, so that a leading end of the sheet is abutted against an inlet of nip of said rotary feed means.

Explaining the correction of the skew-feed of the sheet in the sheet feeding apparatus having the above-mentioned construction, in the case where sheets such as plain papers having less resiliency are used, since the load applied to the rotary sheet supply means during the reverse feeding of the sheet by means of the rotary feed means is relatively small, a loop is formed in the sheet between the nip of the rotary feed means and the rotary sheet supply means which is stopped by the rotation control means, thus correcting the skew-feed of the sheet. On the other hand, in the case where sheets such as envelopes having greater resiliency are used, since the load applied to the rotary sheet supply means during the reverse feeding of the sheet by means of the rotary feed means is relatively great, the sheet being skew-fed is turned by a reverse feeding force generated by the rotaty feed means and by the rotary sheet supply means rotating reversely while being subjected to the brake load by means of the rotation control means, thus correcting the skew-feed of the sheet by registering a leading end of the sheet with the nip.

According to another aspect of the present invention, there is provided a sheet feeding apparatus comprising a sheet supporting means for stacking and supporting sheets, a rotary sheet supply means for feeding out the sheets stacked on the sheet supporting means, a rotary feed means for feeding the sheet in normal and reverse directions by pinching the sheet into a nip of the rotary feed means, and a biasing means for rotatingly biasing the rotary sheet supply means toward a sheet feeding direction; and wherein a skew-feed of the sheet is corrected by the feeding of the sheet in the reverse direction by means of the rotary feed means and a biasing force of the biasing means regarding the rotary sheet supply means.

Explaining the correction of the skew-feed of the sheet in the sheet feeding apparatus having the above-mentioned construction concretely, in the case where sheets such as plain papers having less resiliency are used, since the load applied to the rotary sheet supply means during the reverse feeding of the sheet by means of the rotary feed means is smaller than the biasing force of the biasing means, a loop is formed in the sheet between the nip of the rotary feed means and the rotary sheet supply means which is stopped, thus correcting the skew-feed of the sheet. On the other hand, in the case where sheets such as envelopes having greater resiliency are used, since the load applied to the rotary sheet supply means during the reverse feeding of the sheet by means of the rotary feed means is greater than the biasing force of the biasing means, the sheet being skew-fed is turned by a reverse feeding force generated by the rotary feed means and by the rotary sheet supply means rotating reversely while being subjected to the biasing force from the biasing means, thus correcting the skew-feed of the sheet by registering a leading end of the sheet with the nip.

DETAILED DESCRIPTION OF THE PREFERRED EMBODIMENTS

First of all, a first embodiment of the present invention will be explained with reference to FIGS. 1 to 15.

This embodiment is a word processor to which a sheet feeding apparatus of the present invention is applied.

General Construction of Word Processor (FIGS. 1 to 4)

Figure 1:
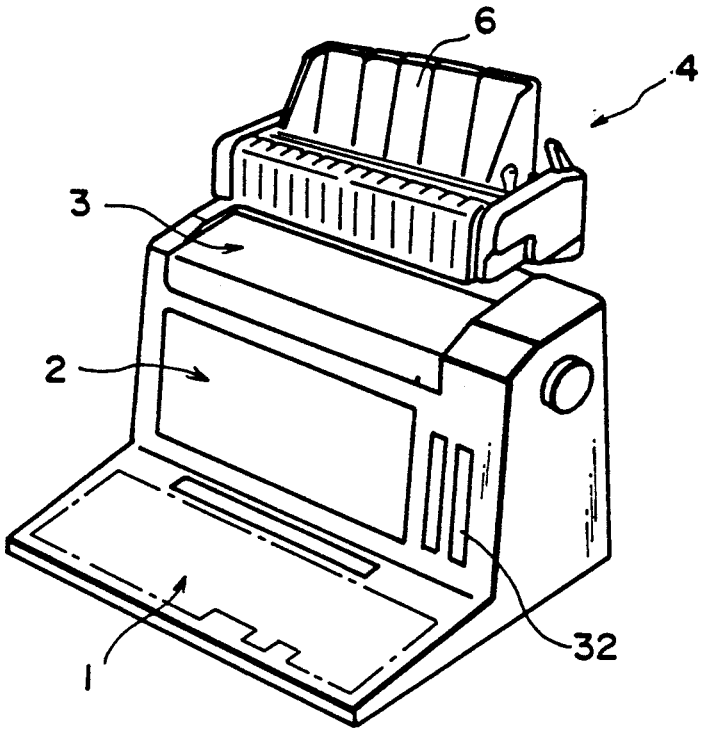
FIG. 1 is a perspective view of a word processor to which a sheet feeding apparatus according to the present invention is applied.

FIG. 1 is a perspective view of the word processor.

The word processor comprises a key board portion 1 for inputting information, a display portion 2 including a CRT for displaying the information, a recording device portion (printer portion) 3 for recording the information on a sheet (recording sheet) acting as a recording medium, and a sheet feeding apparatus portion (referred to as "sheet supply device portion" or "sheet supply device" hereinafter) 4.

Figure 2:
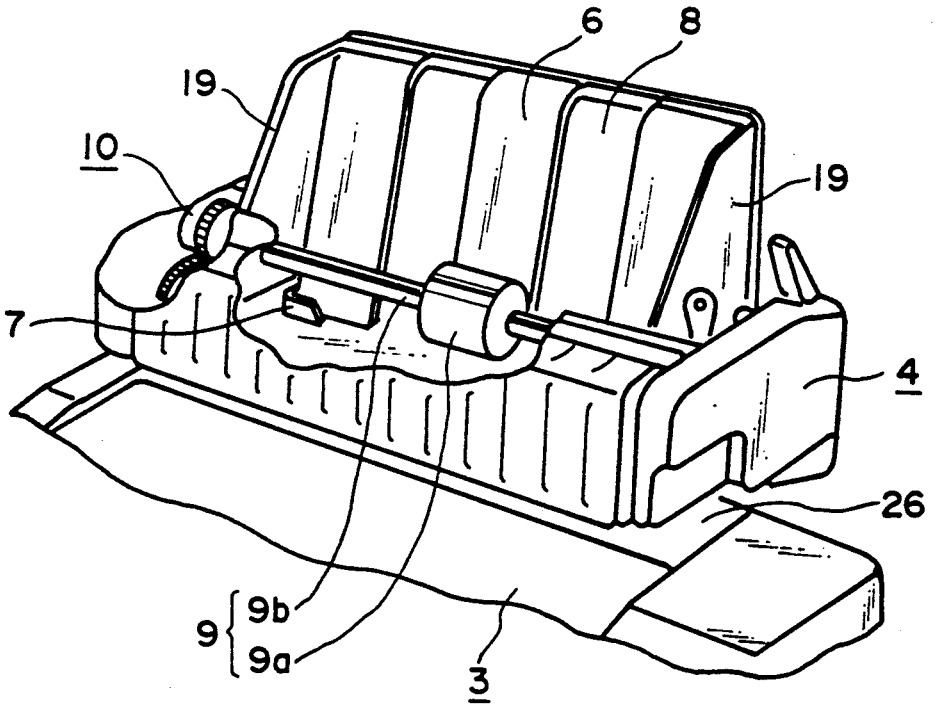
FIG. 2 is a partially broken perspective view of the sheet feeding apparatus.
Figure 3:
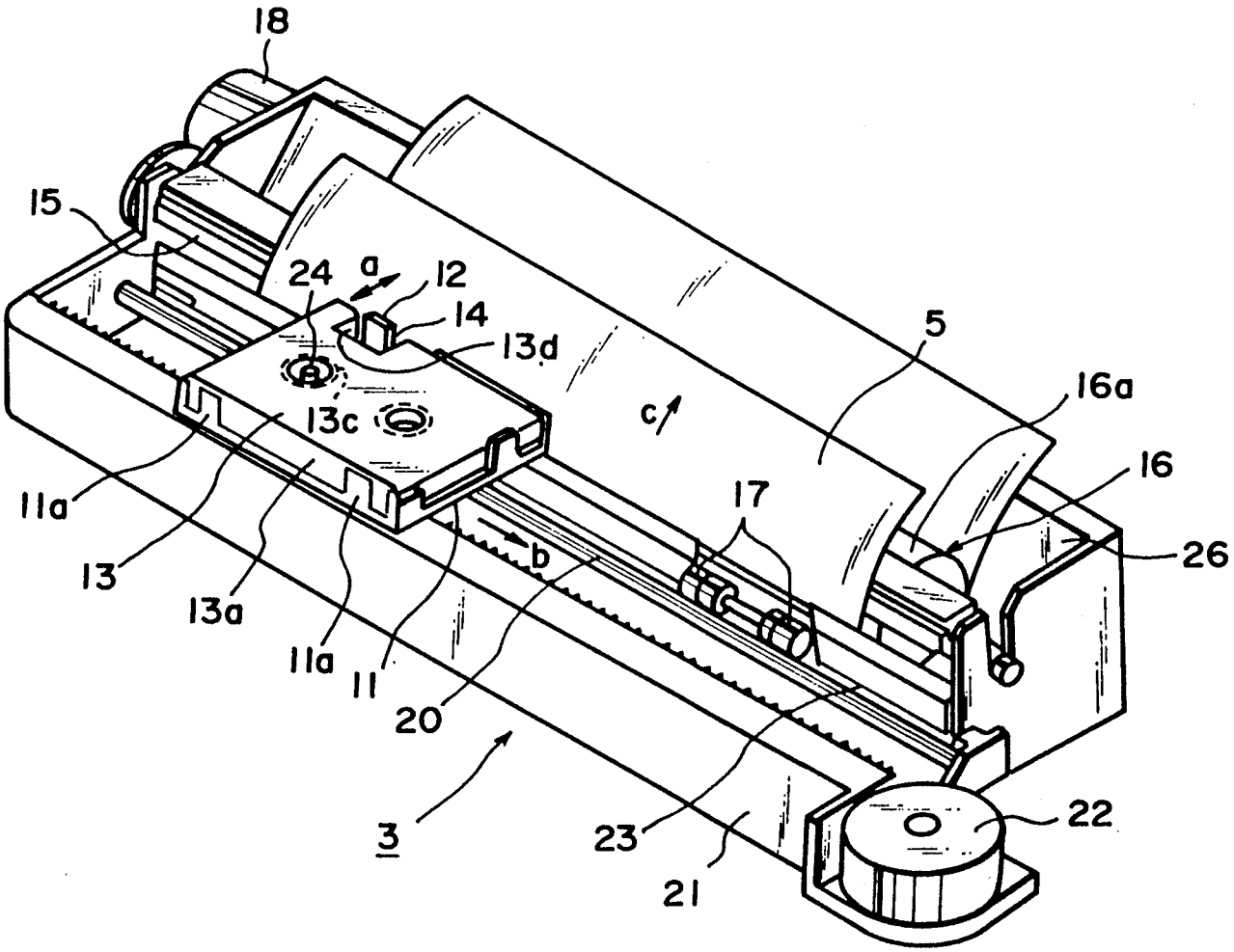
FIG. 3 is a partially broken perspective view of a recording device of the word processor.

The recording device portion 3 is disposed above the display portion 2, and the sheet supply device portion 4 is rested on the recording device portion 3. FIGS. 2 and 3 are partially sectional perspective views showing internal constructions of the sheet supply device portion 4 and the recording device portion 3, respectively.

Figure 4:
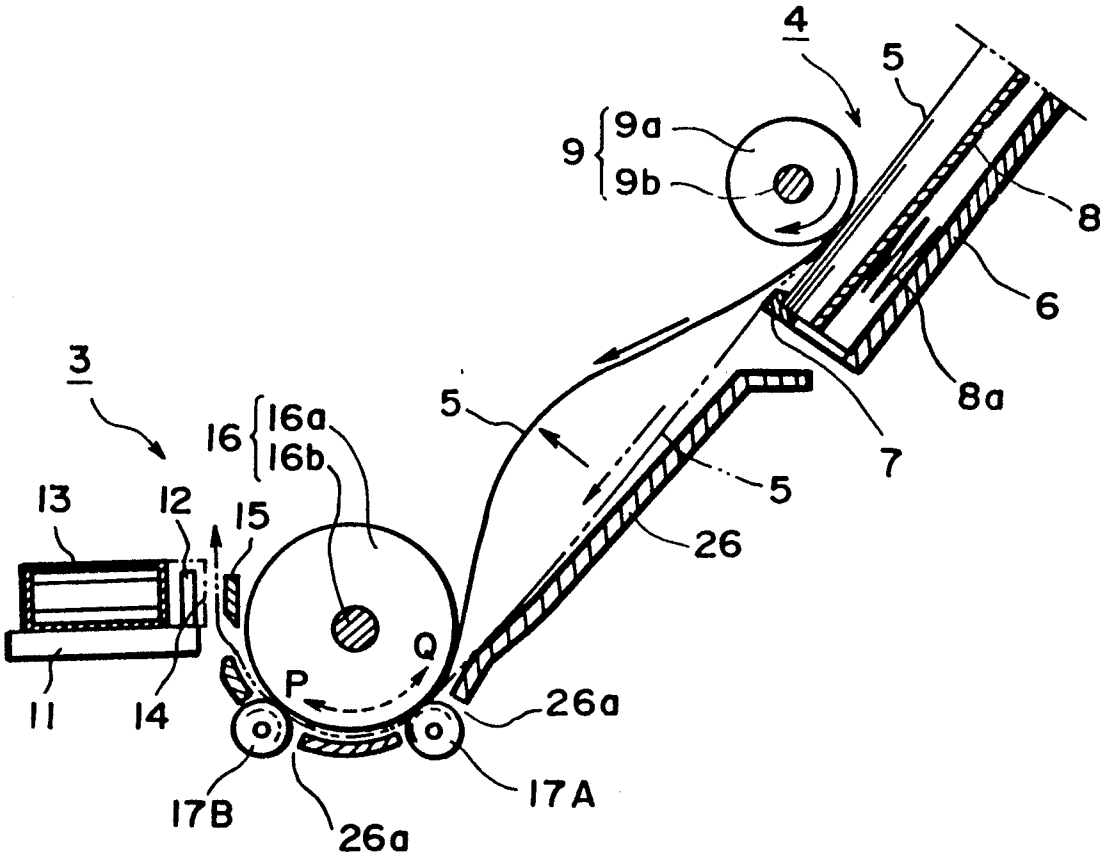
FIG. 4 is a sectional view showing a sheet feeding path from the sheet feeding apparatus to the recording device.

FIG. 4 shows a sheet feeding path from the sheet supply device portion 4 to the recording device portion 3, as already described.

Sheet Supply Device 4 (FIGS. 2, 4–6)

The sheet supply device 4 serves to separate and feed, by means of a sheet supply roller 9 and separating pawls 7, an uppermost sheet on a sheet stack 5 stacked on a sheet support plate 6 which is inclined forwardly and downwardly.

The sheet supply roller 9 acting as a sheet supply means is rotatably supported by side frames 19 of the sheet support plate 6 at both ends of a shaft portion **9*b* of the roller. A drive transmitting means 10 (FIGS. 2, 8 and 9) which will be described later is disposed at one end of the shaft portion 9*b* of the sheet supply roller and is connected to a feed motor (FIG. 3) which acts as a sheet feed drive means of the recording device 3** and will be described later.

Figure 5:
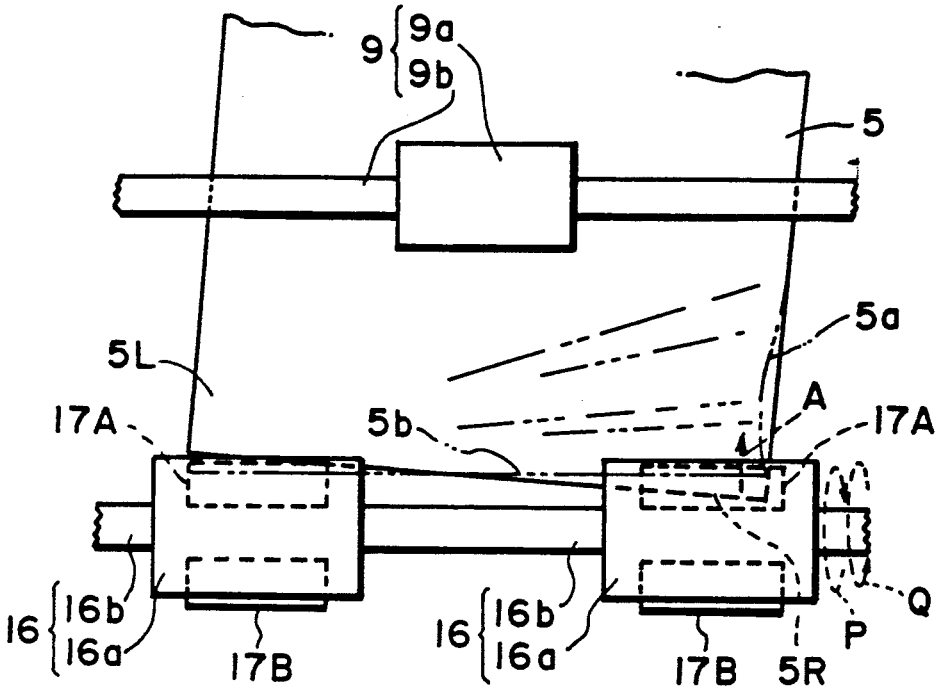
FIGS. 5 to 7 are plan views for explaining the correction of the skew-feed of the sheet.

FIG. 5 shows a positional relation between the sheet supply roller 9 of the sheet supply device 4 and a sheet feed roller 16 of the recording device 3. The sheet supply roller 9 comprises a single roller portion **9*a* fixedly mounted on the shaft portion 9*b* at a longitudinal central portion thereof, and the sheet feed roller 16 comprises a pair of roller portions 16*a* fixedly mounted on a shaft portion 16*b* on both sides of a longitudinal central portion thereof, so that the roller portion 9*a* of the sheet supply roller 9 is positioned between the two roller portions 16*a* of the sheet feed roller 16**.

Figure 6:
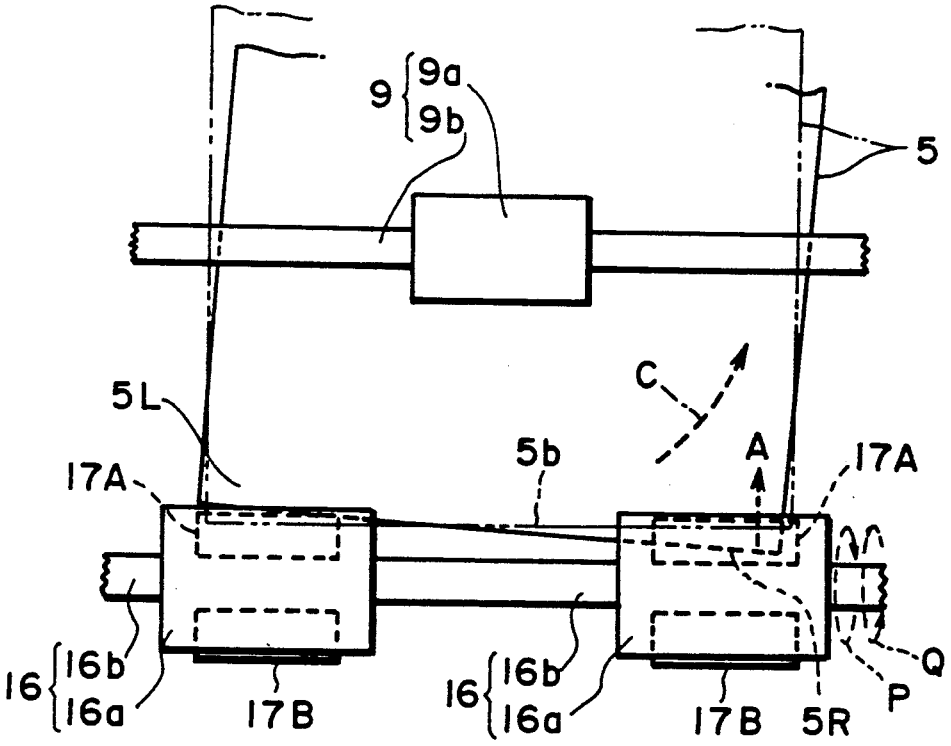

Operation for Correcting Skew-feed of Sheet (FIGS. 5, 6)

FIG. 5 shows a condition that the sheet 5 separated from the sheet supply device 4 is skew-fed and reaches a nip between the sheet feed roller 16 and a first pinch rollers 17A.

In FIG. 5, since a right corner 5R of the leading end of the sheet 5 is advanced forwardly of the left corner 5L of the leading end of the sheet, even when the right corner 5R reaches and is pinched by the nip between the right roller portion **16*a* and the first pinch rollers 17A, the left corner 5L does not yet reach the nip between the left roller portion 16*a* and the first pinch rollers 17A**.

From this condition, when the sheet feed roller 16 is rotated in a reverse direction Q (opposite to a sheet feeding direction) to disengage a clutch as will be described later, the left corner 5L of the sheet 5 is not fed back by the reverse rotation of the sheet feed roller 16 because it is not pinched by the left roller portion **16*a* and the first pinch rollers 17A; however, since, the right corner 5R of the sheet 5 is pinched by the right roller portion 16*a* and the first pinch rollers 17A, the right corner 5R of the sheet is fed back by a sheet returning force A due to the reverse rotation of the sheet feed roller 16, thus disengaging the right corner of the sheet from the corresponding nip between right roller portion 16*a* and the first pinch rollers 17A**.

In this case, when the sheet has less resiliency, a bent loop **5*a* is formed in the sheet between the sheet supply roller 9 and the sheet feed roller 16** by the returning movement A of the right corner 5R of the sheet. As a result, due to the reaction of the bent loop, the leading edge of the sheet 5 is abutted against both nip between the left roller portion 16*a* and the first pinch roller 17A and nip between the right roller portion 16*a* and the first pinch rollers 17A, as shown by the phantom line 5*b*.

That is to say, the leading end of the sheet 5 which was skew-fed is registered with the longitudinal direction of the left and right roller portions 16*a* of the sheet feed roller 16. Thus, when the sheet feed roller is then rotated in the normal direction P, the sheet 5 is fed to the aforementioned recording head (recording portion) 12 without the skew-feed of the sheet.

On the other hand, when the sheet 5 has greater resiliency, the sheet 5 is rotated in an anti-clockwise direction C in FIG. 6 around a contacting point between the sheet and the sheet supply roller 9 by the returning movement A of the right corner 5R of the sheet 5 due to the reverse rotation of the sheet feed roller 16, until the right corner 5R of the sheet 5 is disengaged from the nip between the right roller portion 16*a* and the first pinch rollers 17A. As a result, the leading edge of the sheet 5 is abutted against both nip between the left roller portion 16*a* and the first pinch rollers 17A and nip between the right roller portion 16*a* and the first pinch rollers 17A, as shown by the phantom line 5*b* in FIG. 6. That is to say, also in this case, the leading end of the sheet 5 which was skew-fed is registered with the longitudinal direction of the left and right roller portions 16*a* of the sheet feed roller 16. Thus, when the sheet feed roller is then rotated in the normal direction P, the sheet 5 is fed to the recording head 12 without the skew-feed of the sheet.

In the case shown in FIG. 6, if the sheet 5 is not rotated in the anti-clockwise direction C in FIG. 6 around the contacting point between the sheet and the sheet supply roller 9, the right corner 5R of the sheet 5 will not be fed back from the nip between the right roller portion 16*a* and the first pinch rollers 17A, with the result that the skew-feed of the sheet cannot be corrected and the sheet may be damaged due to the relative slipping movement between the sheet and the reverse rotating sheet feed roller 16.

In order to rotate the sheet 5 in the direction C around the contacting point between the sheet and the sheet supply roller 9, it is necessary to rotate the sheet supply roller 9 in a direction opposite to the sheet feeding direction or to feed back the sheet 5 with the returning movement A due to the reverse movement of the sheet feed roller 16 by a force stronger than a contacting friction force between the sheet supply roller 9 and the sheet 5.

In the case where the sheet 5 is fed back with the returning movement A by the force stronger than the contacting friction force between the sheet supply roller 9 and the sheet 5, the friction force is determined by urging force between the sheet supply roller 9 and the sheet 5 and a coefficient of friction of the sheet supply roller 9, and, further, such urging force and coefficient of friction are determined by a force required to separate the sheets 5 one by one. Generally, the urging force between the sheet supply roller 9 and the sheet 5 is set to have a value of 200–500 grams, and the coefficient of friction of the sheet supply roller 9 is set to have a value of 1–1.5. If the urging force is weaker, it is impossible or unreliable to separate the sheets one by one; whereas, if the urging force is stronger, two or more sheets will be fed at a time (double-feed of the sheets).

In the sheet supply roller (sheet supply means) 9 having the urging force and coefficient of friction as mentioned above, it is difficult to rotate the sheet in the direction C in opposition to the above-mentioned friction force only with the returning force A due to the reverse rotation of the sheet feed roller 16. Further, if the resiliency of the sheet 5 is stronger, since the bent loop 5*a* as described regarding FIG. 5 cannot be formed in the sheet portion between the sheet supply roller 9 and the sheet feed roller 16, the relative slipping movement will occurs between the reverse rotating sheet feed roller 16 and the sheet (pinched by the roller 16 and the first pinch rollers 17A).

Accordingly, since the urging force and the coefficient of friction cannot be set to have small values as mentioned above, if the resiliency of the sheet 5 is stronger, it is necessary to rotate the sheet supply roller 9 in the direction opposite to the sheet feeding direction, in order to rotate the sheet 5 in the direction C as shown in FIG. 6.

Figure 8:
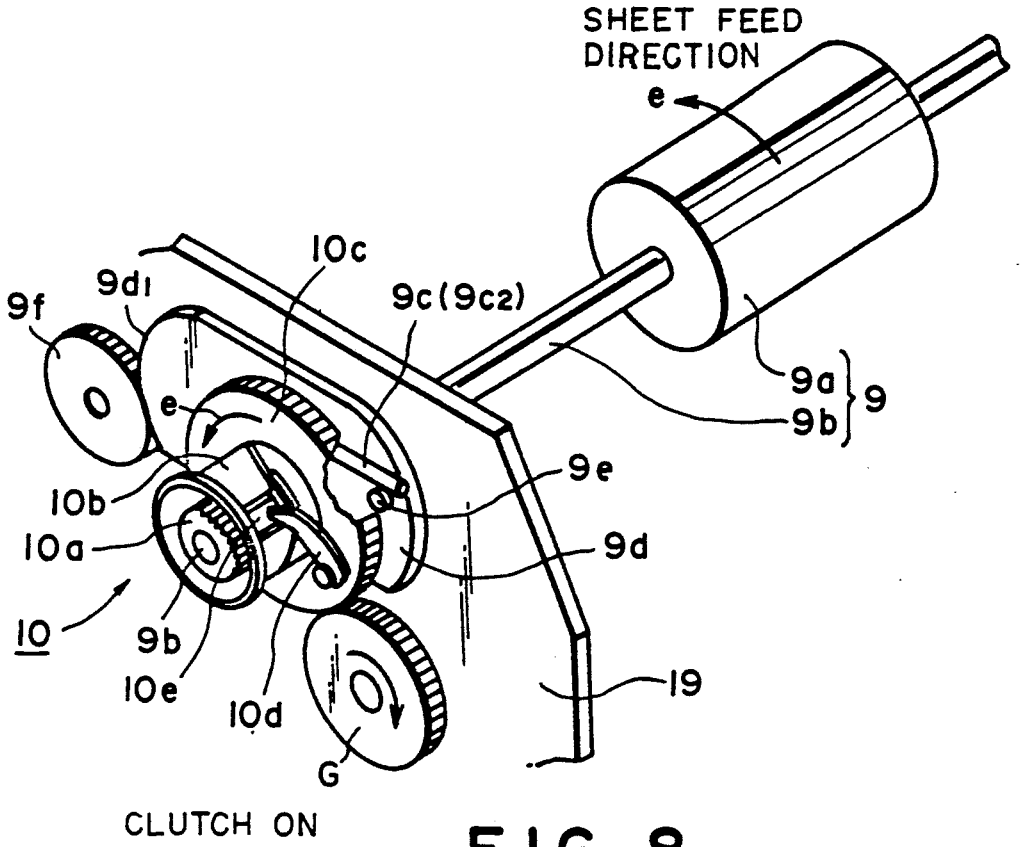
FIG. 8 is a partially broken perspective view of a drive transmitting means in a clutch ON condition.
Figure 9:
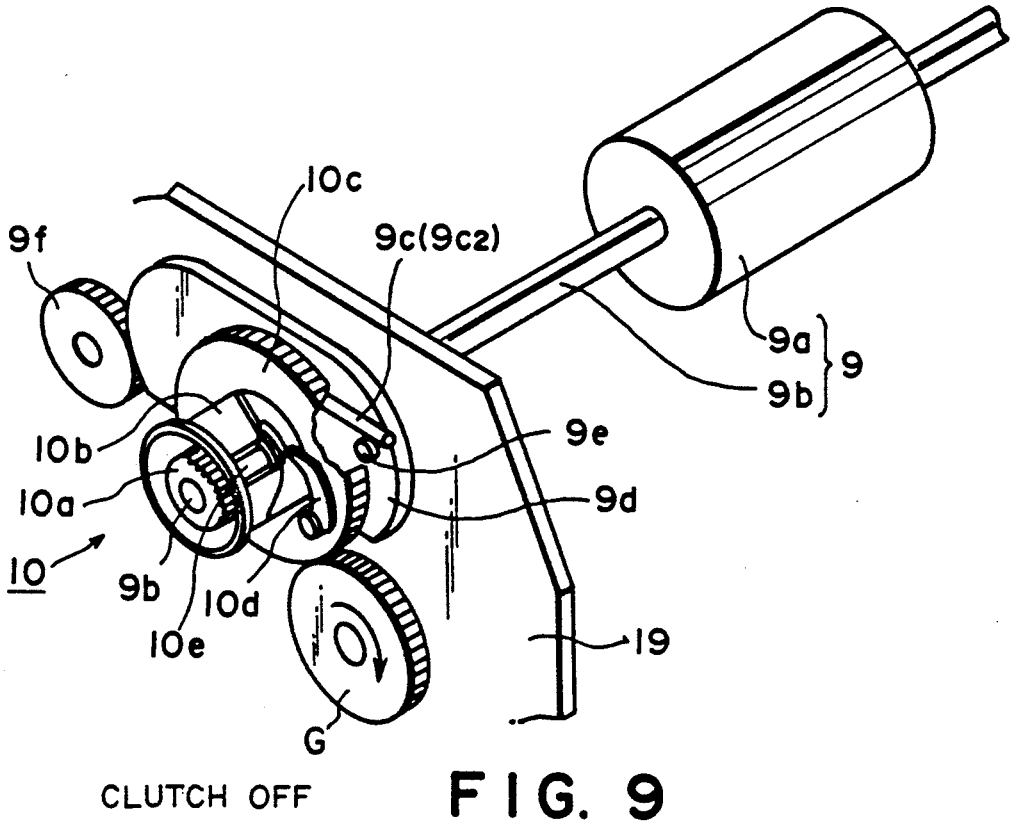
FIG. 9 is a partially broken perspective view of the drive transmitting means in a clutch OFF condition.

Clutch (FIGS. 8 to 10)

Next, a clutch for performing the connection and disconnection between the feed motor 18 (FIG. 3) and the sheet supply roller 9 will be explained.

As shown in FIGS. 8 and 9, the drive transmitting means 10 comprising a sheet supply gear 10*a*, clutch 10*b*, clutch gear 10*c* and the like is arranged at one end of the shaft portion 9*b* of the sheet supply roller 9. The sheet supply gear 10*a* is coaxially and fixedly mounted on the shaft portion 9*b*, and the clutch 10*b* comprises a tubular member coaxially and freely rotatably mounted on the shaft portion 9*b*, and the clutch gear 10*c* is also coaxially and freely rotatably mounted on the shaft portion 9*b*. The clutch 10*b* is positioned radially outwardly of the sheet supply gear 10*a* in coaxial with the latter.

A clutch pawl 10*d* is rockably mounted on a surface of the clutch gear 10*c* which faces toward the clutch 10*b*, so that, when the clutch gear 10*c* is rotated, a free end of the clutch pawl 10*d* slides on a peripheral surface of the cylindrical clutch 10*b*. The clutch pawl 10*d* is always biased toward the clutch 10*b* by means of a spring (not shown) and can be shifted along its pivot to some extent.

FIG. 8 shows a clutch ON condition, wherein the free end of the clutch pawl 10*d* is engaged with notch opening 10*e* formed in the peripheral surface of the clutch 10*b* to engage with the sheet supply gear 10*a*. In this condition, when the normal rotational force of the feed motor 18 is transmitted to the clutch gear 10*c* through a relay gear train G (only the last one of gear train is shown), the rotation of the clutch gear 10*c* is transmitted to the sheet supply gear 10*a*, with the result that the sheet supply roller 9 is rotated in the sheet feeding direction shown by the arrow e.

FIG. 9 shows a clutch OFF condition, wherein the clutch pawl 10*d* is disengaged from the sheet supply gear 10*a* due to the reverse rotation of the feed motor 18.

Figure 10A:
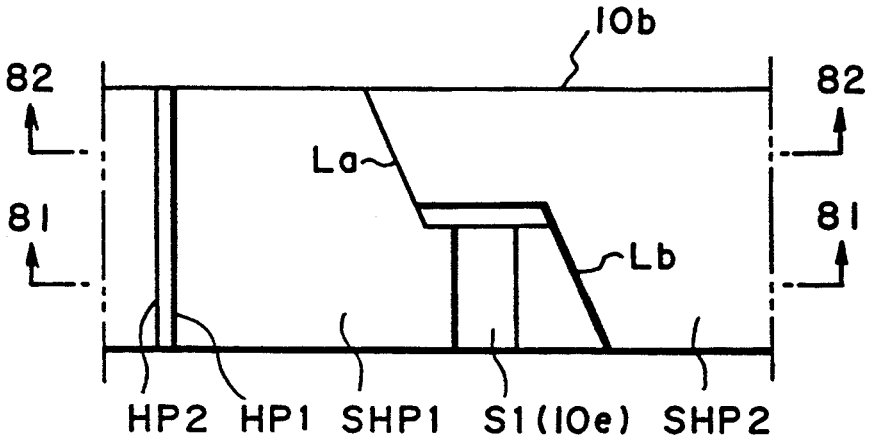
FIG. 10A is a development view of peripheral surface of the clutch.
Figure 10B:
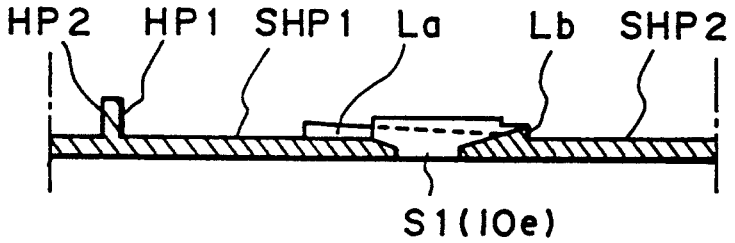
FIGS. 10B and 10C are sectional views taken along the lines 81—81 and 82—82 of FIG. 10A, respectively.
Figure 10C:
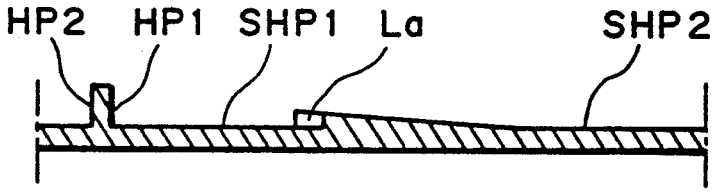
Figure 11:
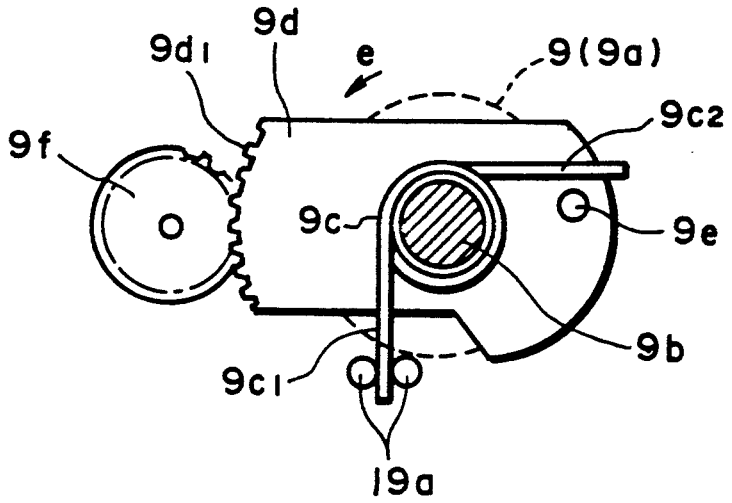
FIGS. 11 and 12 are side views showing the operation of a torque limiter.
Figure 12:
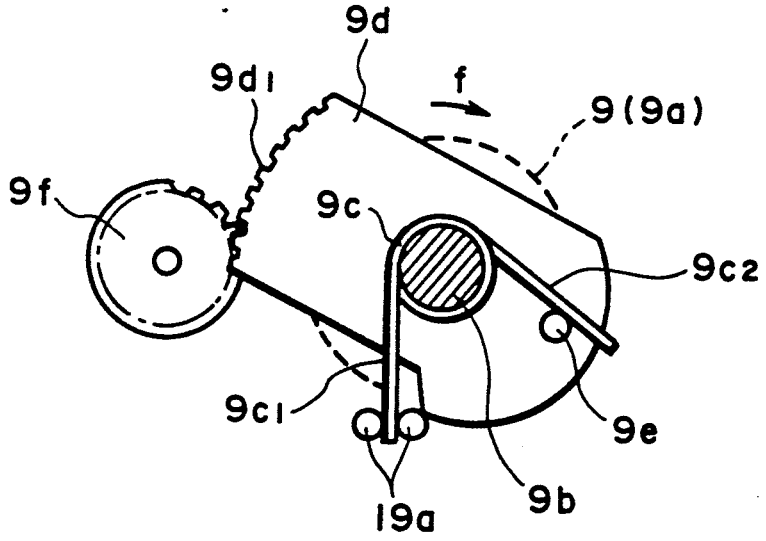

FIG. 10A is a development view of the peripheral surface of the clutch 10*b*, and FIGS. 10B and 10C are sectional views of the clutch taken along the lines 81—81 and 82—82, respectively. In these Figures, stopper surfaces HP1, HP2 are formed on the peripheral surface of the clutch 10*b*. Incondentally, a symbol S1 denotes the above-mentioned notch opening 10*e*.

Between an area SHP1 adjacent to the stopper surface HP1 and an area SHP2 adjacent to the stopper surface HP2, stepped borders La and Lb are formed. When the clutch pawl 10*d* moves from the stopper HP1 to the stopper HP2, it passes through the border Lb; whereas, when the clutch pawl 10*d* moves from the stopper HP2 to the stopper HP1, it passes through the border La.

The direction in which the clutch pawl 10*d* moves from the stopper HP2 to the stopper HP1 corresponds to the sheet feeding direction (normal direction), and the direction in which the clutch pawl 10*d* moves from the stopper HP2 to the stopper HP1 corresponds to the reverse direction. In FIGS. 8–10, in order to surely insert the clutch pawl 10*d* into the notch opening S1 whereever the clutch pawl 10*d* is positioned, the initialization operation is performed so that the clutch pawl 10*d* is shifted up to the stopper surface HP1. A distance between the stopper surface HP1 and the notch opening S1 is constant (corresponding to four printing lines in the illustrated embodiment), and, accordingly, so long as the clutch pawl 10*d* is positioned at the stopper HP1, it is easy to surely shift the clutch pawl into the notch opening S1.

If the clutch pawl 10*d* is positioned in an area between the notch opening S1 and the border Lb, when the clutch pawl 10*d* is shifted toward the stopper HP1, the clutch pawl 10*d* is inserted into the notch opening S1 to establish the clutch ON condition. To avoid this, the initialization operation is performed after the clutch pawl 10*d* is initially shifted to the stopper HP2.

Since the clutch pawl 10*d* surely moves from the stopper HP2 to the stopper HP1, the initialization operation can be effected by shifting the clutch pawl 10*d* to the stopper HP2 and then by shifting the clutch pawl toward the stopper HP1.

In this way, by rotating the feed motor 18 in the normal and reverse directions, it is possible to switch the connection and disconnection to the sheet supply roller 9.

Torque Limiter (FIGS. 8, 9, 11, 12)

The reference numeral 9*c* denotes a tightening spring acting as a drive control means (torque limiter) mounted on one end of the shaft portion 9*b* of the sheet supply roller 9. One end $9c_1$ (FIGS. 11 and 12) of the spring 9*c* is fixedly sandwiched between two projections 19*a* formed on the frame 19. The spring 9*c* acting as the torque limiter permits the normal rotation (to the direction e in FIGS. 8 and 11) of the sheet supply roller 9 without any load when a sheet feeding force to the normal direction e acts on the sheet supply roller 9 and prohibits the reverse rotation (to a direction f in FIG. 12) of the sheet supply roller 9 when a sheet feeding force to the reverse direction f acts on the sheet supply roller 9 by decreasing an inner diameter of the spring 9*c*. The force of the spring 9*c* by which the shaft portion 9*b* is tightened is greater than the maximum sheet feeding force during the feeding and separating of the single sheet 5 by means of the sheet supply roller 9 and is smaller than a sheet feeding force generated by the sheet feed roller 16 and the pinch rollers 17A, 17B.

The reference numeral 9*d* denotes a clutch lever acting as a means for changing the operating force of the torque limiter on the basis of the kind of sheets to be used and/or temperature/humidity in the apparatus. The clutch lever 9*d* is rotatably supported by the shaft portion 9*b* of the sheet supply roller, and a free end of the lever is provided with a toothed portion $9d_1$ arranged along a circle having a center positioned at the shaft portion 9*b*, which toothed portion is meshed with a gear 9*f* rotatably mounted on the frame 19. The gear 9*f* can be reversibly rotated by clutch motor (not shown), so that the normal and reverse rotations of the gear 9*f* cause the normal and reverse rocking movements of the clutch level 9*d* around the shaft portion 9*b*, respectively. The clutch 9*d* is provided with a projection 9*e* associated with the other end $9c_2$ of the tightening spring 9*c* acting as the torque limiter.

When the sheet feeding force to the reverse direction f (FIG. 12) acts on the sheet supply roller 9, the other end $9c_2$ of the rotating spring 9*c* is abutted against the projection 9*e* to regulate an amount of the rotational movement of the other end $9c_2$, thus preventing the inner diameter of the spring 9*c* from being further decreased. That is to say, the projection 9*e* serves to limit the tightening force of the spring 9*c* acting on the shaft portion 9*b*. When the clutch lever 9*d* is rotated, since the positional relation between the projection 9*e* and the other end $9c_2$ of the spring 9*c* is changed, it is possible to control the inner diameter of the spring 9*c*, and, thus, to control the tightening force of the spring 9*c* acting on the shaft portion 9*b*. Consequently, it is possible to change or vary a reverse rotational force of the sheet supply roller 9 provided by the sheet feeding force.

When the sheet supply roller 9 is rotated by a predetermined time period after the leading end of the sheet 5 fed by the sheet supply roller 9 has just reached the nip between the sheet feed roller 16 and the first pinch rollers 17A urged against the sheet feed roller, the sheet feed roller 16 is rotated reversely until the leading end of the sheet is returned to the nip between the sheet feed roller 16 and the first pinch rollers 17A. As a result, the reverse rotation of the sheet supply roller 9 is prevented by the action of the torque limiter 9*c* attached to the shaft portion 99*b* of the sheet supply roller 9, so that a bent loop is formed in the sheet 5 between the sheet feed roller 16 and the sheet supply roller 9, as shown by the solid line in FIG. 4.

By forming such bent loop, the leading end of the sheet 5 is urged against the nip between the sheet feed roller 16 and the first pinch rollers 17A due to the resiliency of the sheet itself. By this urging action, it is possible to register the leading edge of the sheet with the longitudinal direction of the sheet feed roller 16, and, thus, to feed the sheet without any skew-feed of the sheet.

Figure 13:
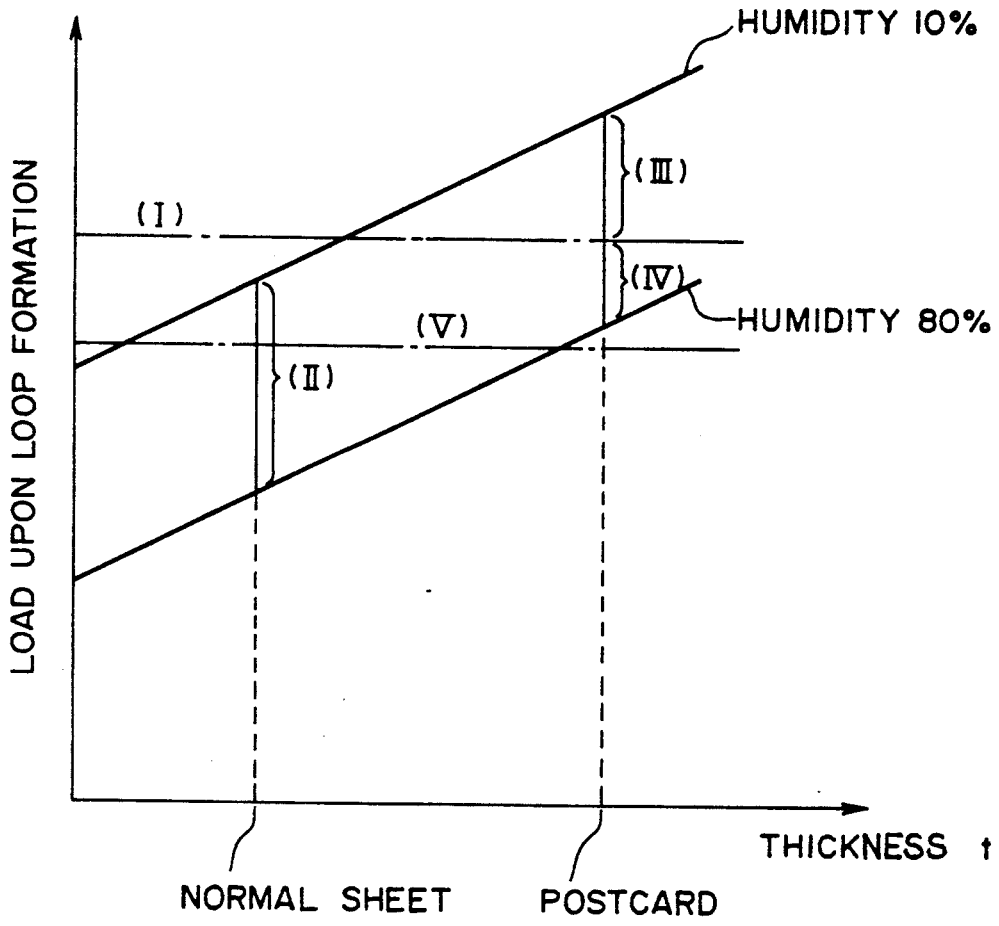
FIG. 13 is a graph showing a relation between a thickness of the sheet and a load during the formation of a loop.

Next, the operation of the torque limiter will be explained with reference to FIG. 13 showing a relation between a thickness t of the sheet 5 and a load (acting on the sheet supply roller 9) upon the bent loop formation.

Now, the cases where normal sheets (or plain sheets) and postcards are used as the sheets will be described. Generally, a thickness of the normal sheet is 40–100 μm and a thickness of the postcard is 230 μm, and, since the thickness of the postcard is greater than that of the normal sheet by about 2–5 times, the resiliency of the postcard greatly differs from that of the normal sheet.

Further, the resiliency of the sheet varies with the humidity. Two solid lines shown in FIG. 13 show the changes in load to the sheet supply roller 9 when the bent loops are formed under the humidity of 10% and 80%, respectively. Generally, the higher the humidity the greater the load, and the greater the thickness of the sheet the greater the load. The minumum rotational load in the reverse direction acting on the sheet supply roller 9 (this roller cannot be rotated below the minimum load) should be greater than the sheet separating force. Thus, normally, the minimum load is set to a load shown by a chain and dot line (I) in FIG. 13. In this case, as shown in a range defined by the solid line (II), since the load regarding the normal sheet is always smaller than the load shown by the chain and dot line (I), when the sheet feed roller 16 is rotated reversely, the bent loop is formed in the sheet.

However, in case of the postcard, when the sheet feed roller 16 is rotated reversely, the bent loop can be formed within a range defined by the solid line (IV), but, cannot be formed (as shown by the phantom line in FIG. 4) within a range defined by the solid line (III), with the result that the sheet supply roller 9 is rotated reversely or there arises the relative slipping movement between the sheet and the sheet supply roller 9, thus damaging the sheet. Thus, in case of the postcard, by reducing the operating force of the torque limiter 9c up to a value shown by a chain and dot line (V) so that the feeding force of the sheet reversely fed overcomes the operating force of the torque limiter 9c, it is possible to always rotate the sheet supply roller 9 reversely, thus preventing the sheet from being damaged by the sheet supply roller.

Further, even in case of the postcard, it is possible to form the bent loop in the sheet by increasing the operating force of the torque limiter 9c above the chain and dot line (I). However, this method is unsuitable, because the postcard is folded or the rigidity of the apparatus must be increased.

In this way, since the resiliency of the sheet itself is varied in accordance with the kind of sheets and/or humidity/temperature in the apparatus, the feeding force of the sheet reversely fed will be also varied as mentioned above. Thus, by changing the position of the projection 9e in accordance with the kind of sheets and/or humidity/temperature in the apparatus, it is possible to set the spring force of the tightening spring 9c as the torque limiter so that the sheet supply roller can be rotated reversely by a force smaller than the aforementioned sheet feeding force.

Figure 7:
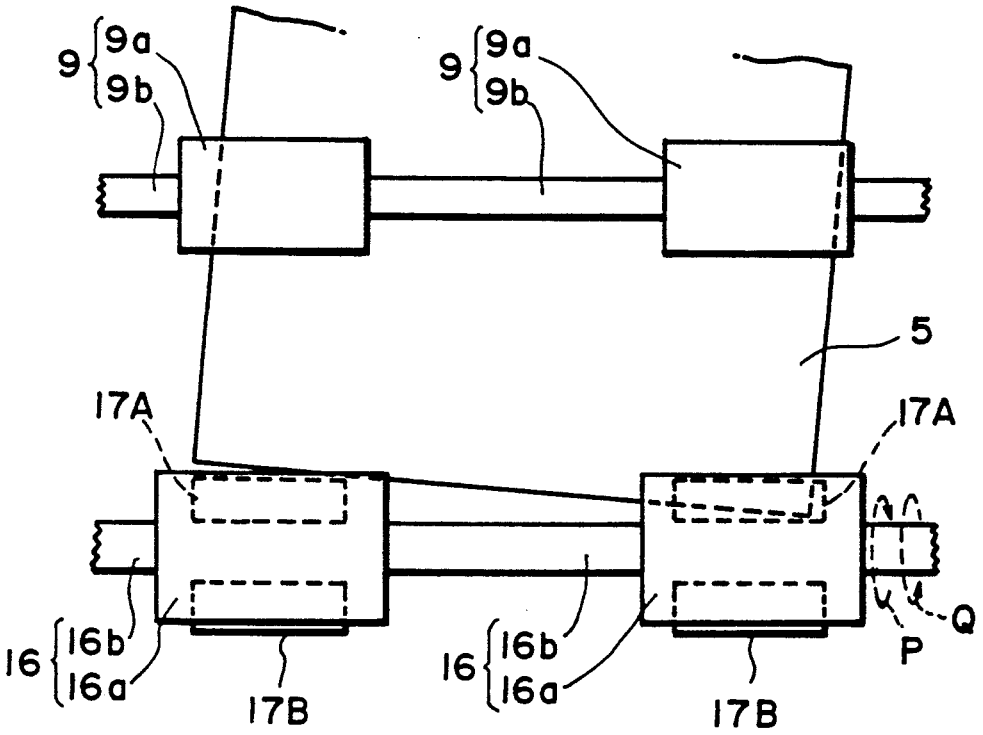

Further, in this embodiment, while an example that the sheet supply roller 9 has the single roller portion 9a was explained, for example, as shown in FIG. 7, the sheet supply roller may comprise a pair of roller portions 9a. In this case, by arranging these roller portions so that a center between the roller portions 9a is aligned with a center between the roller portions 16a in the sheet feeding direction and by providing the aforementioned torque limiter for each of the roller portions 9a, it is possible to achieve the same advantage as that obtained by the single roller portion 9a.

Temperature/humidity Detection Means

Temperature/humidity detection means (not shown) for detecting the temperature and humidity in the sheet supply device and the recording device used with the sheet supply device are disposed in the system in place. The temperature detection means is a thermistor and the like, and the humidity detection means is constituted by a humidity-sensitive element of electrostatic capacity type and the like. By detecting the temperature/humidity in the system by means of the temperature/humidity detection means, it is possible to automatically vary a current amount to the recording head 12 and/or to automatically control the clutch motor for controlling the torque limiter 9c.

Recording Device 3

In FIG. 3, the carriage 11 is slidably attached to a guide shaft 20 both ends of which are secured to a frame 21 of the recording device. Driven pulleys (not shown) in synchronous with a carriage motor 22 are also rotatably attached to the frame 21, and a timing belt 23 extending between the driven pulleys is connected to the carriage 11. With this arrangement, when the carriage motor 22 is rotated normally and reversely, the carriage 11 is reciprocally shifted along the guide shaft 20.

Further, a take-up shaft 24 mounted on the carriage 11 in place can receive a take-up core 13c of the ink ribbon cassette 13, so that, as the carriage 11 is shifted in the direction b, the ink ribbon 14 is taken-up wound around the take-up core. The ink ribbon cassette 13 has a container 13a within which the take-up core 13c and a supply core 13c are rotatably received. The ink ribbon 14 is wound on the supply core 13b. The ink ribbon 14 extends from the supply core 13b and passes through a recess 13d of the container 13 to be exposed to the outside, and then extends to the take-up core 13c.

The ink ribbon 14 is an elongated film and heat-transferable (thermoplastic, thermosetting or thermosublimable) ink coated on the film. Further, the ink ribbon cassette 13 can be mounted on the carriage 11 by fitting it on locking projections 11a formed on the carriage 11. Incidentally, when the cassette 13 is mounted on the carriage 11, the take-up shaft 24 is inserted into the take-up core 13c so that the take-up core 13c is rotated by the rotation of the take-up shaft 24.

In the illustrated embodiment, the recording means comprises a thermal recording head 12 which is constituted by a plurality of heat generating elements (which can be heated by applying electric currents to them) arranged in a line on a substrate. As shown in FIG. 3, the recording head 12 is mounted on the carriage 11 so that, when the ink ribbon cassette 13 is mounted on the carriage 11, the recording head 12 faces the recess 13d of the cassette. Further, the recording head 12 can be shifted up and down by a biasing means (not shown) such as a solenoid. When the recording head is shifted down (head-down), it urges the ink-coated surface of the ink ribbon 14 against the sheet 5 backed-up by the platen 15; whereas, when the recording head is shifted up (head-up), the ink ribbon 14 is separated from the sheet 5.

Accordingly, during the head-down of the recording head 12, when the carriage 11 is shifted to the direction b and the (heat generating elements of the) recording head 12 is selectively energized, the ink molten by the heat of the head is transferred onto the sheet 5, thus recording an image on the sheet. Incidentally, a portion of the ink ribbon 14 used in the recording operation is wound around the take-up core 13c by the rotation of the take-up shaft 24.

When one line recording is finished in this way, the recording head 12 is shifted up, the carriage 11 is returned to its home position, and the sheet 5 is fed by one line in the direction c.

As mentioned above, the sheet feed means 16 for feeding the sheet 5 comprises the roller portions 16a and the pinch rollers 17, and the feed motor 18 is connected to the sheet feed roller 16 via the drive transmitting gear train. Thus, when the feed motor 18 is driven, the sheet feed roller 16 is rotated so that the sheet 5 supplied from the sheet supply device 4 is guided along the peripheral surface of the feed roller 16 and is fed in the direction c between the platen 15 and the ink ribbon 14.

Figure 14:
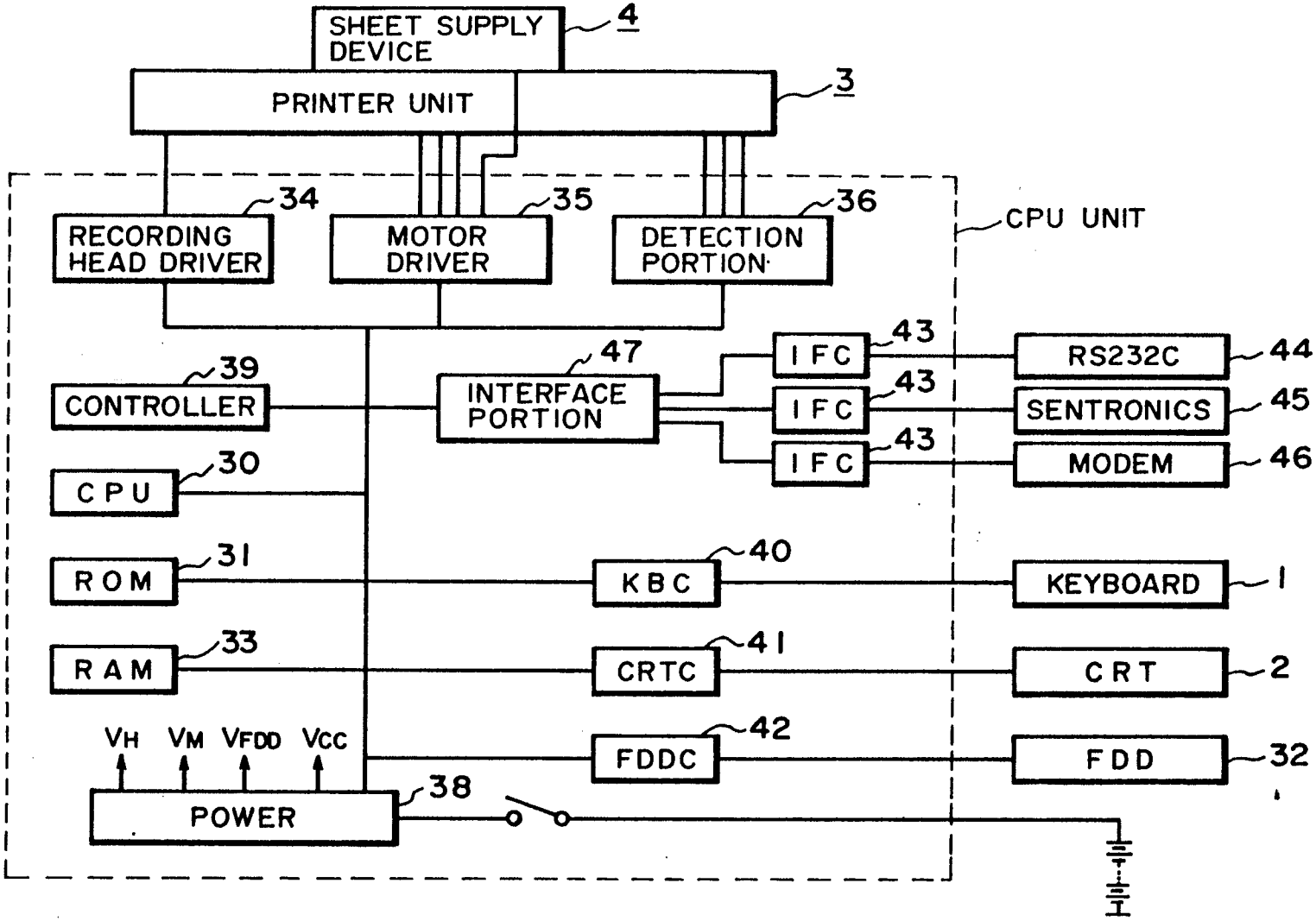
FIG. 14 is a block diagram of a control system.

Control Means (FIG. 14)

Next, a control means for controlling the sheet supply device 4 and the recording device 3 used with the sheet supply device will be explained.

FIG. 14 is a block diagram of the control system. This block diagram only shows a connecting relation between blocks, and the detailed control lines are omitted. Further, elements included within a broken line box constitute a CPU unit.

A CPU 30 is a central operation processing unit and serves to read out programs and various data from a ROM 31 and/or a floppy disc driver 32 (FIG. 1, described later) and to perform the required calculations and judgements to control various elements. The ROM 31 is a read only memory and serves to store various programs for activating the CPU 30, and various data required for the recording, such as character codes, dot patterns (character generator CG) and the like. A RAM 33 is a read/write memory and includes a working area where the data commanded by the CPU 30 and the calculation results are temporarily stored, a buffer area where various data from the key board 1, external interface portion 47 or floppy disc driver 32 are stored, and a text are where the documents or sentences are stored.

Further, the CPU unit is connected to the printer unit 3 via a recording head driver 34, motor driver 35 and detection portion 36. The recording head driver 34 drives the recording head 12 in the printer unit 3 under the control of the CPU 30, and the motor driver 35 drives the feed motor 18 (FIG. 3), carriage motor 22 (FIG. 3) and clutch motor of the sheet supply device 4 under the control of the CPU 30.

The detection portion 36 transmits detection information from a ribbon sensor provided in the printer unit 3 for detecting the presence of the ink ribbon or from a temperature/humidity detection sensor for detecting the temperature/humidity in the system to the CPU 30. A power source 38 controls a drive voltage $V_H$ for the recording head 12, a drive voltage $V_M$ for the feed motor 18, carriage motor 22 and clutch motor, a drive voltage $V_{FDD}$ for the floppy disc driver 32, and a drive voltage $V_{CC}$ for other logic circuits. Further, a controller 39 performs various controls such as the transfer of the recording data of the recording head 12, the changing of the voltage/current of the drive source $V_H$ and the like, under the control of the CPU 30.

The keyboard 1 for inputting various data required for the recording and display is connected to the CPU unit via a keyboard connector (KBC) 40. Further, the display portion 2 including the CRT for displaying various information and data inputted from the keyboard 1 is also connected to the CPU unit via a CRT connector (CRTC) 41. Incidentally, the display portion 2 may comprise a liquid crystal display or other display elements, in place of the CRT.

Further, the floppy disc driver 32 is connected to the CPU unit via a floppy disc driver connector (FDDC) 42. Incidentally, in place of the floppy disc, a hard disc or an external RAM can be used. The CPU unit can be connected to an RS232C 44, sentronics 45 and MODEM 46 via interface connectors (IFC) 43 to perform the control of the recording device 3 under the control of an external control equipment and the communication to external equipment.

Figure 15:
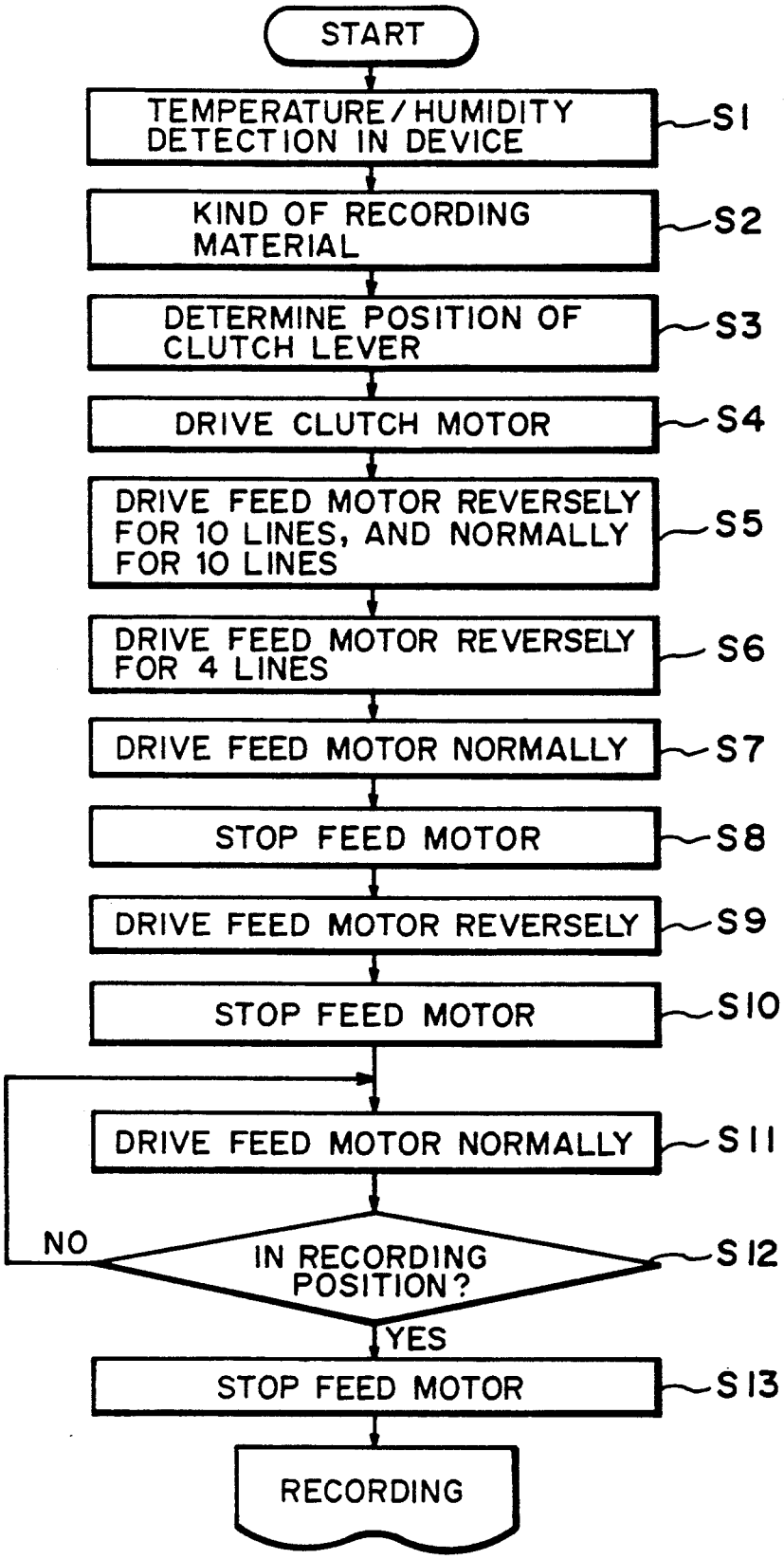
FIG. 15 is a flow chart showing a sheet feeding sequence.
Figure 16:
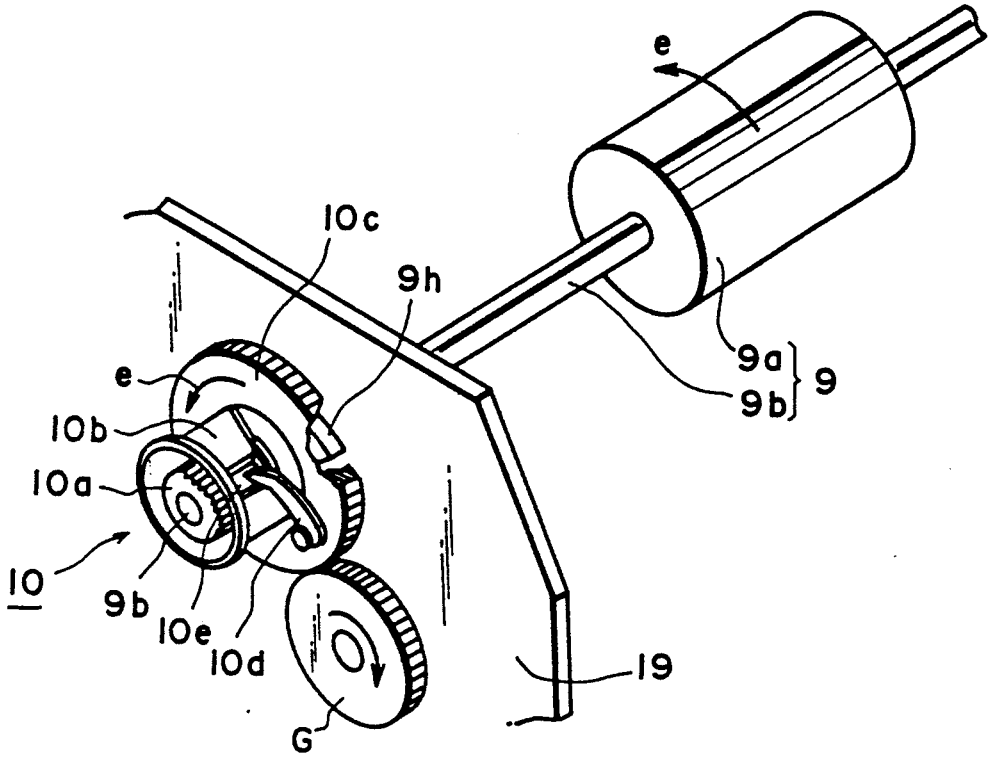
FIG. 16 is a partially broken perspective view of a drive transmitting means according to another embodiment in a clutch ON condition.
Figure 17:
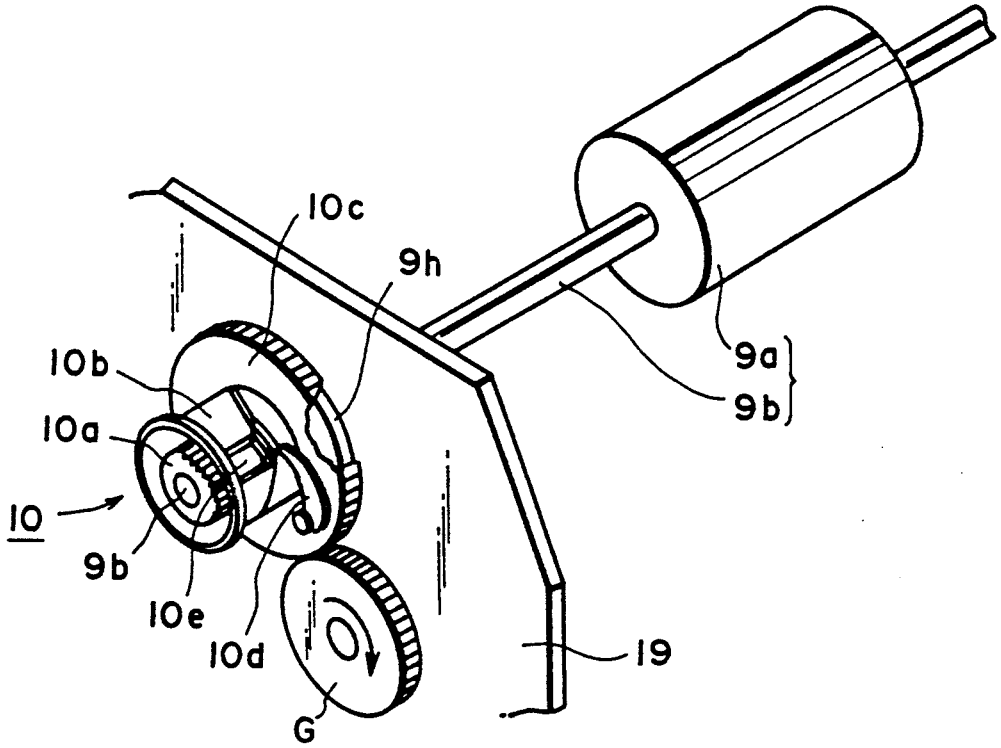
FIG. 17 is a partially broken perspective view of the drive transmitting means in a clutch OFF condition.

Control Sequence (FIG. 15)

Next, a control sequence for performing the recording operation by means of the sheet supply device 4 and the recording device 3 having the above-mentioned constructions will be explained with reference to a flow chart shown in FIG. 15.

When the recording command is emitted, the recording device 3 firstly detects the temperature/humidity in the apparatus by the temperature/humidity detection means, and then judges the sheet information inputted from the keyboard 1 or detected by the means for the kind of sheet, and determines the rotational position of the clutch lever **9*d* for obtaining the optimum spring force of the torque limiter 9*c* (steps S1, S2, S3). Then, by driving the clutch motor, the clutch lever 9*d* is positioned to the determined position (step S4**).

Thereafter, by rotating the feed motor reversely for 10 lines and then normally for 10 lines, the clutch pawl **10*d* is shifted to the stopper surface HP1 (FIG. 10) (step S5). Then, the feed motor 18 is rotated reversely for 4 lines to shift the clutch pawl 10*d* from the stopper HP1 to the notch opening S1 (10*e*), thus establishing the clutch ON condition (FIG. 8) (step S6**).

Thereafter, by rotating the feed motor normally, the sheet supply roller 9 is rotated to feed the sheet to the recording device 3 (step S7). When the leading end of the sheet exceeds the nip between the sheet feed roller 16 and the first pinch roller 17A, the feed motor is stopped (step S8).

Then, the feed motor 18 is driven reversely to rotate the sheet feed roller 16 reversely (step S9). When the leading end of the sheet 5 is returned to the nip between the sheet feed roller 16 and the first pinch roller 17A, the feed motor is stopped (step S10). Further, the feed motor 18 is driven normally to feed the sheet until the sheet faces the recording portion of the recording head 12, and then the feed motor is stopped (steps S11, S12, S13).

In this way, the sheet can be fed to a desired position for the recording operation.

Next, a second embodiment of the invention will be explained with reference to FIGS. 16 to 20.

In this second embodiment, in place of the torque limiter mechanism **9*a*, 9*c*, 9*d*, 9*e*, 9*f* (FIGS. 8, 9, 11 and 12) acting as the drive control means disposed between the sheet supply roller (sheet supply means) 9 and the drive transmitting means 10 (sheet supply gear 10*a*, clutch 10*b*, clutch gear 10*c* and the like) in the above-mentioned first embodiment, a power accumulating mechanism 9*g*–9*j* acting as a biasing means operated only when the sheet supply roller 9 is subjected to the feeding force in the direction f opposite to the sheet feeding direction e is arranged between the sheet supply roller (sheet supply means) 9 and the drive transmitting means 10**.

The construction of the word processor and the sheet supply device, and the correction of the skew-feed of the sheet, as well as construction of the clutch, recording device, control means and the like are the same as those in the first embodiment.

Biasing Means (Power Accumulating Mechanism **9*g*–9*j***)

A spring holder **9*h* is attached to one end of the shaft portion 9*b* of the sheet supply roller via a one-way baring 9*i*, so that, when the sheet supply roller 9 is rotated in the direction f opposite to the sheet feeding direction e, the spring holder 9h can be rotated in the direction f through the one-way bearing 9i. Further, a spring 9g is provided, which spring has one end secured to a pin 9j formed integrally with the spring holder 9h and the other end secured to a projection 19b formed on the frame 19**.

Figure 18:
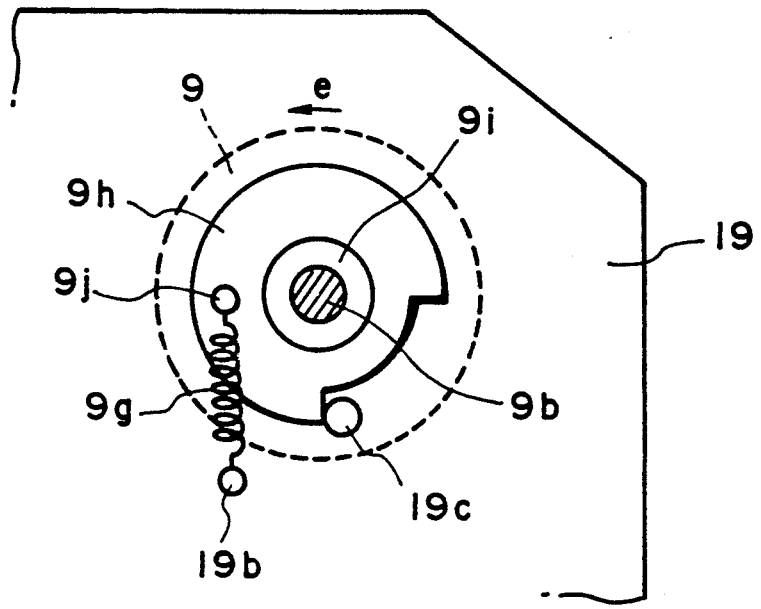
FIGS. 18 and 19 are side views showing the operation of the biasing means.

FIG. 18 shows a condition that the sheet supply roller 9 is rotated in the sheet feeding direction e (normal direction). In this condition, the sheet supply roller 9 is not subjected to the force of the power accumulating mechanism 9g–9j in its rotational direction.

Figure 19:
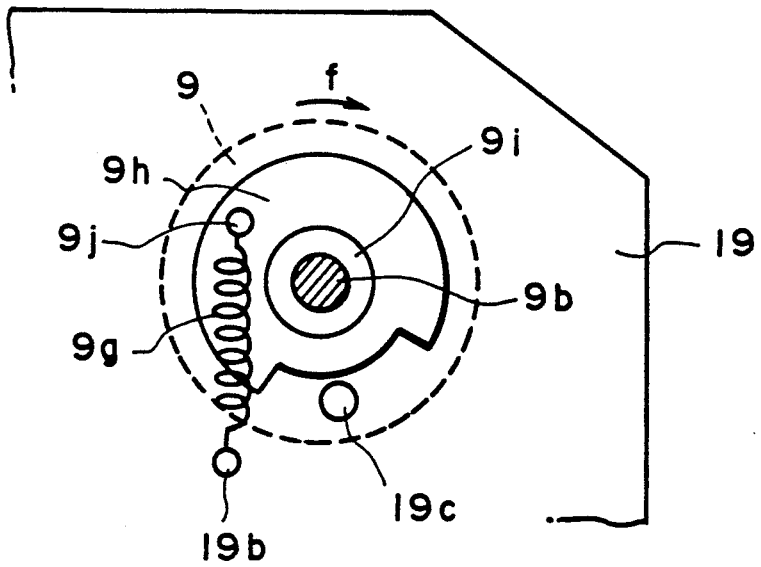

FIG. 19 shows a condition that the sheet supply roller 9 is rotated in the direction f (reverse direction) opposite to the sheet feeding direction. In this condition, the spring holder 9h is rotated in the direction f via the one-way bearing 9i in opposition to the spring 9g to charge the spring 9g, thus biasing the sheet supply roller 9 in the normal direction e.

Thus, when the shifting force (due to the reverse rotation Q of the sheet feed roller 16) tending to feed the sheet in the reverse direction is stronger than the force of the spring, it is possible to rotate the sheet supply roller 9 reversely. Further, even when the resiliency of the sheet, i.e., the sheet returning force in the reverse direction f opposite to the sheet feeding direction e is weaker, if the spring force is made weaker, it is possible to rotate the sheet supply roller 9 in the reverse direction f. That is to say, by setting the spring force stronger than the sheet returning force, the reverse rotation of the sheet supply roller 9 can be prevented, and, by setting the spring force weaker than the sheet returning force, the reverse rotation of the sheet supply roller 9 can be permitted.

From the condition shown in FIG. 5, when the sheet feed roller 16 is rotated in the direction f opposite to the sheet feeding direction e to perform the disengagement of the clutch, the left corner 5L of the leading end of the sheet 5 is not fed back by the returning movement due to the reverse rotation of the sheet feed roller 16 because it is not pinched by the nip between the left roller portions 16a and the first pinch roller 17A. However, the right corner 5R of the sheet 5 is pinched by the nip between the right roller portions 16a and the first pinch roller 17A, and right corner 5R of the sheet is fed back by thre returning movement A due to the reverse rotation of the sheet feed roller 16, thus disengaging the right corner of the sheet from the nip between the right roller portions 16a and the first pinch roller 17A.

During this feed back movement of the sheet 5, the sheet supply roller 9 is rotated reversely by the sheet 5, thus charging the spring 9g. In this condition, when the reverse rotation of the sheet feed roller 16 is stopped, the leading end of the sheet 5 is abutted against both left and right nips between the roller portions 16a and the first pinch rollers 17A by the spring force, thus registering the leading end of the sheet with the longitudinal direction of the sheet feed roller 16.

Accordingly, when the sheet feed roller 16 is then rotated in the normal direction P, the sheet 5 is fed to the recording portion 12 without the skew-feed of the sheet. In this way, by rotating the sheet supply roller 9 reversely, it is possible to correct the skew-feed of the sheet.

Control Sequence

Figure 20:
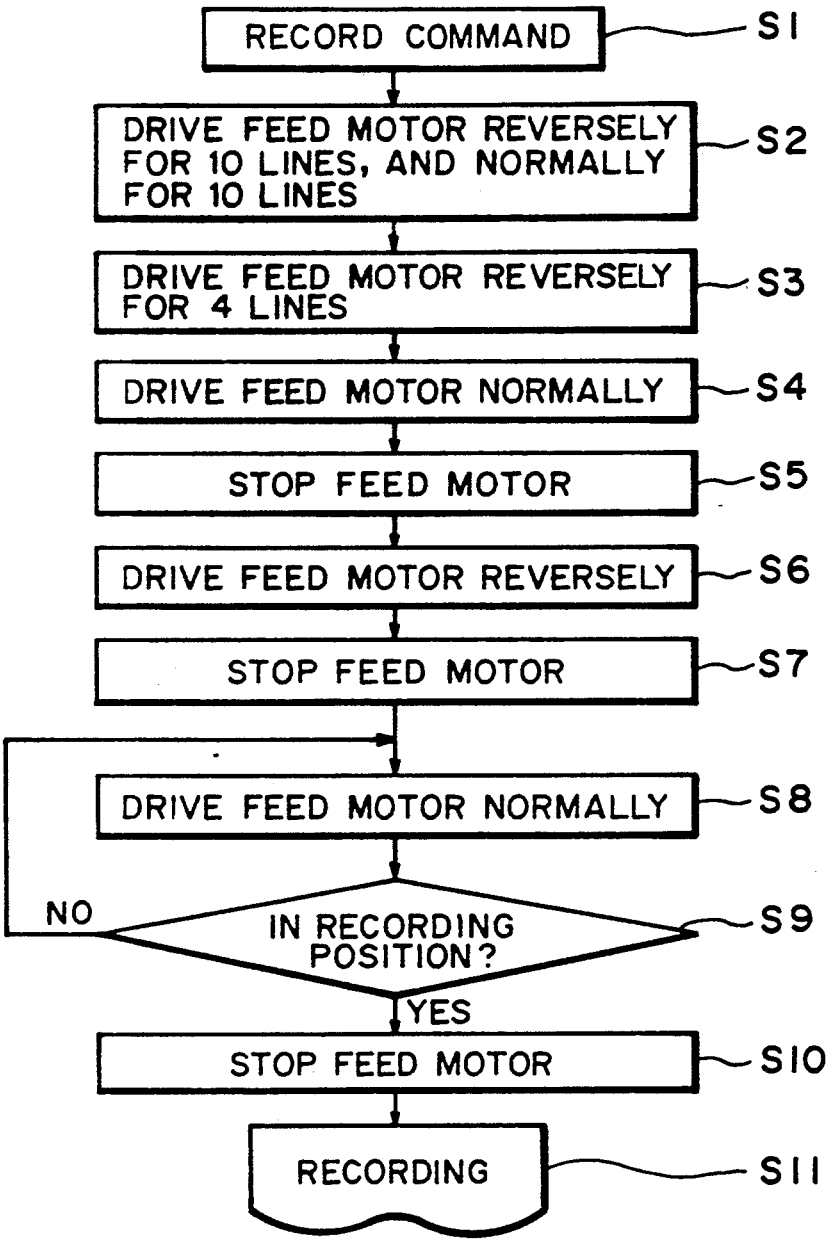
FIG. 20 is a flow chart showing a sheet feeding sequence.

Next, a control sequence for performing the recording operation by means of the sheet supply device and the recording device having the above-mentioned constructions will be explained with reference to a flow chart shown in FIG. 20.

When the recording command is given (step S1), the recording device firstly rotates the feed motor 18 reversely for 10 lines and then normally for 10 lines, thus shifting the clutch pawl 10d to the stopper surface HP1 (FIG. 10) (step S2). Then, the feed motor 18 is rotated reversely for 4 lines to shift the clutch pawl 10d from the stopper HP1 to the notch opening S1 (FIG. 10), thus establishing the clutch ON condition (step S3).

Thereafter, by rotating the feed motor normally, the sheet supply roller 9 is rotated to feed the sheet to the recording device (step S4). When the leading end of the sheet exceeds the nip between the sheet feed roller 16 and the first pinch roller 17A, the feed motor is stopped (step S5).

Then, the feed motor 18 is driven reversely to rotate the sheet feed roller 16 reversely (step S6). When the leading end of the sheet 5 is returned to the nip between the sheet feed roller 16 and the first pinch roller 17A, the feed motor 18 is stopped (step S7). Further, the feed motor 18 is driven normally to feed the sheet until the sheet faces the recording portion of the recording head 12, and then the feed motor 18 is stopped (steps S8, S9, S10).

In this way, the sheet 5 can be fed to a desired position for the recording operation by means of the recording head 12.

Finally, alterations or modifications will be explained.

(1) In the above first and second embodiment, while the heat-transfer recording device of serial type was explained, a heat-transfer recording device of line type may be adopted to the present invention. Further, the present invention is not limited to the heat-transfer recording system, but can utilize various recording systems such as an ink jet recording system, wire dot recording system, laser beam recording system and the like.

(2) Further, while an example that the sheet is guided along the peripheral surface of the sheet feed roller to feed the sheet was explained, the present invention is not limited to this example, but, the sheet may be fed horizontally through the nip between the sheet feed roller and the pinch roller or may be fed by a conveyor belt and the like.

(3) Further, while the separating pawls were explained as the sheet separating means, the present invention is not limited to the separating pawls, but may utilize an inclined surface sheet separating system for separating the sheet by the use of an inclined surface to other appropriate separating system.

(4) Furthermore, while an example that the bent loop is formed by rotating the feed roller reversely after the sheet is pinched by the nip between the feed roller and the pinch roller was explained, the present invention is not limited to this example. For example, the bent loop may be formed by rotating the feed roller reversely during the rotation of the sheet supply roller or the sheet may be fed back by rotating the sheet supply roller and then by rotating the sheet feed roller.

(5) In this first embodiment, an example that the clutch lever is driven by the motor was explained, the present invention is not limited to this example. For example, the clutch lever may be driven in synchronous with the operation of the sheet supply drive means or by an appropriate means such as a solenoid.

Figure 21:
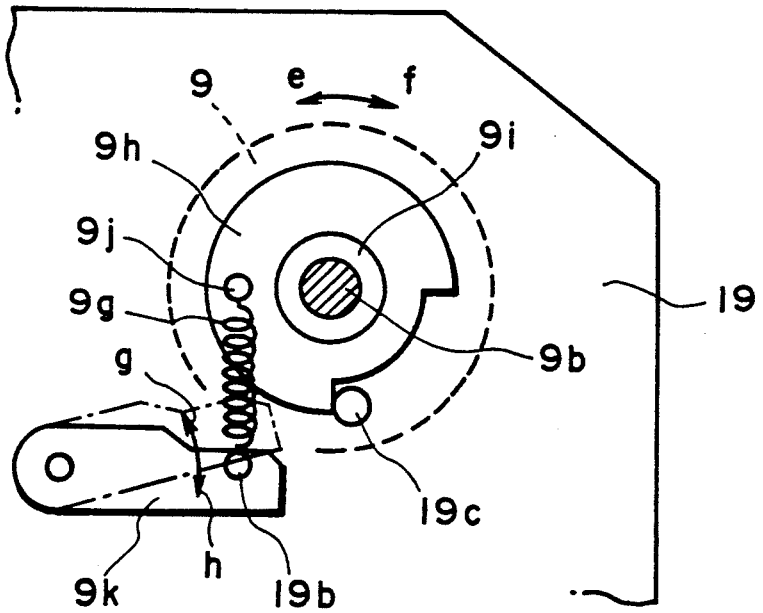
FIG. 21 is a side view of a biasing means according to another embodiment.

(6) In the second embodiment, while an example that the spring 9g attached to the sheet supply roller has a constant charged force if the sheet is fed back by a constant amount was explained, for example, as shown in FIG. 21, a spring lever 9k to which one end of the spring 9g may be rotatably mounted on the frame 19 so that the charged force of the spring 9g can be varied by rotating the spring lever 9k in a direction g (reducing the charged force) or in a direction h (increasing the charged force), with the result that it is possible to bias the sheet 5 toward the sheet feed roller 16 always by a constant force regardless of the change in the feed back amount of the sheet due to the variation in the resiliency of the sheet or to vary the biasing force in accordance with the resiliency of the sheet.

The charged force of the spring 9g may be changed by the input from the keyboard 1, or on the basis of sheet information from the sensor, or manually.

(7) In the above embodiments, while the skew-feed of the sheet was corrected between the sheet supply roller 9 for feeding out the sheet rested on the sheet support plate 6 and the sheet feed roller 16, a second feed roller may be disposed between the sheet supply roller 9 and the sheet feed roller 16 and the present invention may be applied to this second feed roller so that the skew-feed of the sheet can be corrected between these feed rollers.

What is claimed is:

1. A sheet feeding apparatus, comprising:

a sheet support means for supporting sheets;

a rotary sheet supply means for feeding out the sheets supported on said sheet support means;

a rotary feed means for feeding the sheet in normal and reverse directions with respect to a sheet feeding direction; and load set means for restricting rotation of said rotary sheet supply means by the sheet when load applied to said rotary sheet supply means in the reverse rotation direction from the sheet fed by said rotary feed means in the reverse direction is smaller than predetermined value, and for applying brake load to said rotary sheet supply means so that it is rotated by the sheet when the load in reverse rotation direction from the sheet is larger than the predetermined value;

wherein skew-feed of the sheet is corrected by the sheet being fed in the reverse direction by said rotary feed means to said rotary sheet supply means to which a brake load is applied by said load set means, so that a leading end of the sheet is abutted against an inlet of a nip of said rotary feed means.

2. A sheet feeding apparatus according to claim 1, wherein the skew-feed of the sheet is corrected by forming a loop in the sheet between the nip of said rotary feed means and said rotary sheet supply means if the reverse rotational load applied to said rotary sheet supply means is below said predetermined value and by registering a leading end of the sheet with said nip by rotating the skew-fed sheet between said rotary feed means and said rotary sheet supply means when the reverse rotational load applied to said rotary sheet supply means is larger than the predetermined value, when the sheet is fed in the reverse direction by means of said rotary feed means.

3. A sheet feeding apparatus according to claim 2, wherein said load set means comprises a torque limiter.

4. A sheet feeding apparatus according to claim 3, wherein said torque limiter includes a tightening spring provided on a drive shaft of said rotary sheet supply means and adapted to tighten said drive shaft, and said spring does not apply the brake load to said drive shaft when the later is rotated in the sheet feeding direction, and apply the brake load to said drive shaft by tightening said drive shaft when said drive shaft is rotated in the direction opposite to the sheet feeding direction.

5. A sheet feeding apparatus according to claim 4, further including an adjusting means for adjusting the brake load by varying a tightening force of said tightening spring.

6. A sheet feeding apparatus according to claim 5, wherein the tightening force of said tightening spring is adjusted by said adjusting means in accordance with the circumstances that the sheet is to be used.

7. A sheet feeding apparatus according to claim 6, wherein said adjusting means includes a humidity measuring means, and means for automatically adjusting the brake load due to said tightening spring so that the brake load is increased as the humidity measured by said humidity measuring means is decreased.

8. A sheet feeding apparatus, comprising:

a sheet support means for supporting sheets;

a rotary sheet supply means for feeding out the sheets supported on said sheet support means;

a rotary feed means for feeding the sheet in normal and reverse directions with respect to a sheet feeding direction; and a biasing means for biasing said rotary sheet supply means toward its normal direction, in opposition to a load directing the reverse rotary direction applied to said rotary sheet supply means from the sheet being fed in the reverse direction toward said rotary sheet supply means by said rotary feed means;

a wherein skew-feed of the sheet is corrected by the sheet fed in the reverse direction by said rotary feed means to said rotary sheet supply means to which a biasing force of said biasing means is applied, so that a leading end of the sheet is abutted against an inlet of a nip of said rotary feed means.

9. A sheet feeding apparatus according to claim 8, wherein the skew-feed of the sheet is corrected by forming a loop in the sheet between the nip of said rotary feed means and said rotary sheet supply means if the load applied to said rotary sheet supply means is below the biasing force of said biasing means and by registering a leading end of the sheet with said nip by rotating the skew-fed sheet between said rotary feed means and said rotary sheet supply means if the load supplied to said rotary sheet supply means si above the biasing force of said biasing means, when the sheet is fed int eh reverse direction toward said rotary sheet supply means by means of said rotary feed means.

10. A sheet feeding apparatus according to claim 9, wherein said biasing means includes a force accumulating means for accumulating a force so that the biasing force is increased when said accumulating means is rotated reversely by the sheet fed in the reverse direction by said rotary feed means.

11. A sheet feeding apparatus according to claim 10, wherein said force accumulating means comprises a one-way bearing for transmitting the reverse rotation of said rotary sheet supply means, a spring holder to which the reverse rotation is transmitted of said rotary sheet supply means when it is connected to said one-way bearing, and an elastic member for biasing said spring holder toward a direction that said rotary sheet supply means is rotated normally.

12. A sheet feeding apparatus according to claim 11, further including an adjusting means for adjusting the biasing force by varying initial flexure of said elastic member.

13. A sheet feeding apparatus according to claim 12, wherein said adjusting means varies the initial flexure in accordance with the circumstances that the sheet is to be used.

14. A sheet feeding apparatus according to claim 13, wherein said adjusting means comprises a humidity measuring means, and means for automatically adjusting the biasing force so that the biasing force is increased by increasing the initial flexure as the humidity measured by said humidity measuring means is decreased.

15. A sheet feeding apparatus, comprising:

a first rotary feed means for feeding a sheet;

a second rotary feed means for feeding the sheet fed from said first rotary feed means in normal and reverse directions with respect to a sheet feeding direction; and load set means for restricting rotation of said first rotary sheet supply means by the sheet when load applied to said first rotary sheet supply means in the reverse rotation direction from the sheet fed by said second rotary feed means in the reverse direction is smaller than predetermined value and for applying brake load to said first rotary feed means so that it is rotated by the sheet when the load in reverse rotation direction from the sheet is larger than the predetermined value;

wherein skew-feed of the sheet is corrected by the sheet being fed in the reverse direction by said second rotary feed means to said first rotary sheet supply means to which brake load is applied by said load set means, so that a leading end of the sheet is abutted against an inlet of a nip of said second rotary feed means.

16. A sheet feeding apparatus according to claim 15, wherein the skew-feed of the sheet is corrected by forming a loop in the sheet between the nip of said second rotary feed means and said first rotary feed means if the load applied to said first rotary feed means is below a predetermined value and by registering a leading end of the sheet with said nip by rotating the skew-fed sheet between said first rotary feed means and said second rotary feed means, if the load applied to said first rotary feed means is above the predetermined value, when the sheet is fed in the reverse direction by said second rotary feed means.

17. A sheet feeding apparatus, comprising:

a first rotary feed means for feeding a sheet;

a second rotary feed means for feeding the sheet fed from said first rotary feed means in normal and reverse directions with respect to a sheet feeding direction; and a biasing means for biasing said first rotary feed means toward its normal direction, in opposition to a load directing the reverse rotary direction applied to said first rotary feed means from the sheet being fed in the reverse direction toward said first rotary feed means by said second rotary feed means;

a wherein skew-feed of the sheet is corrected by the sheet being fed in the reverse direction by said second rotary feed means to said first rotary sheet supply means to which a biasing force of said biasing means is applied by said load set means, so that a leading end of the sheet is abutted against an inlet of a nip of said rotary feed means.

18. A sheet feeding apparatus according to claim 17, wherein the skew-feed of the sheet is corrected by forming a loop in the sheet between the nip of said second rotary feed means and said first rotary feed means if the load applied to said first rotary feed means is below the biasing force of said biasing means and by registering a leading end of the sheet with said nip by rotating the skew-fed sheet between said first rotary feed means and said second rotary feed means if the load applied to said first rotary feed means is above the biasing force of said biasing means, when the sheet is fed in the reverse direction toward said first rotary feed means by means of said second rotary feed means.

19. An image forming system, comprising:

a sheet support means for supporting sheets;

a rotary sheet supply means for feeding out the sheets supported on said sheet support means;

a rotary feed means for feeding a sheet in normal and reverse directions with respect to a sheet feeding direction;

load set means for restricting rotation of said rotary sheet supply means by the sheet when load applied to said rotary sheet supply means in the reverse rotation direction from the sheet fed by said rotary feed means in the reverse direction is smaller than predetermined value, and for applying brake load to said first rotary feed means so that it is rotated by the sheet when the load in reverse rotation direction from the sheet is larger than the predetermined value;

wherein skew-feed of the sheet is corrected by the sheet being fed in the reverse direction by said rotary feed means to said rotary sheet supply means to which a brake load is applied by said load set means, so that a leading end of the sheet is abutted against an inlet of a nip of said rotary feed means; and an image forming means for forming an image on the sheet a skew-feed of which is corrected.

20. An image forming system according to claim 19, wherein the skew-feed of the sheet is corrected by forming a loop in the sheet between the nip of said rotary feed means and said rotary sheet supply means if the reverse rotational load applied to said rotary sheet supply means is below said predetermined value and by registering a leading end of the sheet with said nip by rotating the skew-fed sheet between said rotary feed means and said rotary sheet supply means if the reverse rotational load applied to said rotary sheet supply means is above said predetermined value, when the sheet is fed in the reverse direction by means of said rotary feed means.

21. An image forming system, comprising:

a sheet support means for supporting sheets;

a rotary sheet supply means for feeding out the sheets supported on said sheet support means;

a rotary feed means for feeding the sheet in normal and reverse directions with respect to a sheet feeding direction;

a biasing means for biasing said rotary sheet supply means toward its normal direction, in opposition to a load directing the reverse rotary direction applied to said rotary sheet supply means from the sheet being fed in the reverse direction toward said rotary sheet supply means by said rotary feed means; and an image forming means for forming an image on the sheet a skew-feed of which is corrected, wherein skew-feed of the sheet is corrected by the sheet fed in the reverse direction by said rotary feed means to said rotary sheet supply means to which the biasing force of said biasing means is applied by said biasing means, so that a leading end of the sheet is abutted against an inlet of a nip of said rotary feed means.

22. An image forming system according to claim 21, wherein the skew-feed of the sheet is corrected by forming a loop in the sheet between the nip of said rotary feed means and said rotary sheet supply means if the load applied to said rotary sheet supply means is below the biasing force of said biasing means and by registering a leading end of the sheet with said nip by rotating the skew-fed sheet between said rotary feed means and said rotary sheet supply means if the load applied to said rotary sheet supply means is below the biasing force of said biasing means, when the sheet is fed in the reverse direction toward said rotary sheet supply means by means of said rotary feed means.

23. An image forming system, comprising:

a first rotary feed means for feeding a sheet;

a second rotary feed means for feeding the sheet fed from said first rotary feed means in normal and reverse directions with respect to a sheet feeding direction;

load set means for restricting rotation of said first rotary feed means by the sheet when load applied to said first rotary feed means in the reverse rotation direction from the sheet fed by said second rotary feed means in the reverse direction is smaller than predetermined value and for applying brake load to said first rotary feed means so that it is rotated by the sheet when the load in reverse rotation direction from the sheet is larger than the predetermined value; and an image forming means for forming an image on the sheet a skew-feed of which is corrected, wherein skew-feed of the sheet is corrected by the sheet fed in the reverse direction by said second rotary feed means to said first rotary feed means to which brake load is applied by said load set means, so that a leading end of the sheet is abutted against an inlet of a nip of said second rotary feed means.

24. An image forming system according to claim 23, wherein the skew-feed of the sheet is corrected by forming a loop in the sheet between the nip of said second rotary feed means and said first rotary feed means if the load applied to said first rotary feed means is below a predetermined value and by registering a leading end of the sheet with said nip by rotating the skew-fed sheet between said first rotary feed means and said second rotary feed means if the load applied to said first rotary feed means is above the predetermined value, when the sheet is fed in the reverse direction by means of said second rotary feed means.

25. An image forming system, comprising:

a first rotary feed means for feeding a sheet;

a second rotary feed means for feeding the sheet fed from said first rotary feed means in normal and reverse directions with respect to a sheet feeding direction;

a biasing means for biasing said first rotary feed means toward its normal direction, in opposition to a load direction the reverse rotary direction applied to said first rotary feed means from the sheet being fed in the reverse direction toward said first rotary feed means by said second rotary feed means; and an image forming means for forming an image on the sheet a skew-feed of which is corrected, wherein the skew-feed of the sheet is corrected by the sheet fed in the reverse direction by said second rotary feed means to said first rotary feed means to which biasing force of said biasing means is applied so that a leading end of the sheet is abutted against an inlet of a nip of said second rotary feed means.

26. An image forming system according to claim 25, wherein the skew-feed of the sheet is corrected by forming a loop in the sheet between the nip of said second rotary feed means and said first rotary feed means if the load applied to said first rotary feed means is below the biasing force of said biasing means and by registering a leading end of the sheet with said nip by rotating the skew-fed sheet between said first rotary feed means and said second rotary feed means if the load applied to said first rotary feed means is above the biasing force of said biasing means, when the sheet is fed in the reverse direction toward said first rotary feed means by means of said second rotary feed means.

27. A sheet feeding apparatus, comprising:

sheet support means for supporting a sheet thereon;

rotary sheet supply means for feeding out the sheet supported on said sheet support means;

rotary convey means for conveying the sheet in forward and reverse directions with respect to a sheet conveying direction; and control means for controlling rotation of said rotary sheet supply means in a reverse rotational direction, according to a load applied to said rotary sheet supply means from the sheet conveyed by said rotary convey means, wherein skew-feed of the sheet fed by said rotary sheet supply means is corrected by cooperating of said rotary sheet supply means and said rotary convey means.

28. A sheet feeding apparatus according to claim 28, wherein said control means restricts rotation of said rotary sheet supply means when the load is small, and rotates said rotary sheet supply means in a reverse rotational direction when the load is large.

29. A sheet feeding apparatus according to claim 28, wherein said control means comprises a torque limiter.

30. A sheet feeding apparatus according to claim 28, wherein the skew-feed of the sheet is corrected by forming a loop in the sheet between said rotary convey means and said rotary sheet supply means when the load is small and by registering a leading edge of the sheet with said rotary convey means by rotating the skew-fed sheet between said rotary convey means and said rotary sheet supply means when the load is large.

31. A sheet feeding apparatus, comprising:

first rotary convey means for conveying a sheet;

second rotary convey means for conveying the sheet in forward and reverse directions with respect to a sheet conveying direction; and control means for controlling rotating of said first rotary convey means in a reverse rotational direction according to a load applied to said first rotary convey means from the sheet conveyed by said second rotary convey means, wherein said skew-feed of the sheet fed by said first rotary convey means is corrected by cooperating of said first and second rotary convey means.

32. A sheet feeding apparatus according to claim 31, wherein said control means restricts rotation of said first rotary convey means when the load is small, and rotates said first rotary convey means in a reverse rotational direction when the load is large.

33. A sheet feeding apparatus according to claim 32, wherein said control means comprises a torque limiter.

34. A sheet feeding apparatus according to claim 32, wherein the skew-feed of the sheet is corrected by forming a loop in the sheet between said second and first rotary convey means when the load is small and by registering a leading edge of the sheet with said second rotary convey means by rotating the skew-fed sheet between said second and first rotary convey means when the load is large.

35. An image forming system, comprising:

sheet support means for supporting a sheet thereon;

rotary sheet supply means for feeding out the sheet supported on said sheet support means;

rotary convey means for conveying the sheet in forward and reverse directions with respect to a sheet conveying direction;

control means for controlling rotation of said rotary sheet supply means in a reverse rotational direction, according to a load applied to said rotary sheet supply means from the sheet conveyed by said rotary convey means, skew-feed of the sheet fed by said rotary sheet supply means being corrected by cooperation of said rotary sheet supply means and said rotary convey means; and an image forming means for forming an image on the sheet whose skew-feed is corrected.

36. An image forming apparatus according to claim 35, wherein said control means restricts rotation of said rotary sheet supply means when the load is small, and rotates said rotary sheet supply means in a reverse rotational direction when the load is large.

37. An image forming apparatus according to claim 36, wherein said control means comprises a torque limiter.

38. An image forming apparatus according to claim 36, wherein the skew-feed of the sheet is corrected by forming a loop in the sheet between said rotary convey means and said rotary sheet supply means when the load is small, or by registering a leading edge of the sheet with said rotary convey means by rotating the skew-fed sheet between said rotary convey means and said rotary sheet supply means when the load is large.

39. An image forming system, comprising:

first rotary convey means for conveying a sheet;

second rotary convey means for conveying the sheet in forward and reverse directions with respect to a sheet conveying direction, skew-feed of the sheet fed by said first rotary convey means being corrected by cooperation of said first and second rotary convey means;

control means for controlling rotating of said first rotary convey means in a reverse rotational direction, according to a load applied to said first rotary convey means from the sheet conveyed by said second rotary convey means; and an image forming means for forming an image on the sheet whose skew-feed is corrected.

40. An image forming system according to claim 39, wherein said control means restricts rotation of said first rotary convey means when the load is small and rotates said first rotary convey means in a reverse rotational direction when the load is large.

41. An image forming system according to claim 40, wherein said control means comprises a torque limiter.

42. An image forming system according to claim 40, wherein the skew-feed of the sheet is corrected by forming a loop in the sheet between said second and first rotary convey means when the load is small and by registering a leading edge of the sheet with said second rotary convey means by rotating the skew-fed sheet between said second and first rotary convey means when the load is large.

43. A sheet feeding apparatus, comprising:

first rotary convey means for conveying a sheet;

second rotary convey means for conveying the sheet fed by said first rotary conveying means; and control means for controlling rotating of said first rotary convey in a reverse rotational direction, according to a load applied to said first rotary convey means from the sheet conveyed by said first rotary convey means to said second rotary convey means, wherein skew-feed of the sheet fed by said first rotary convey means is corrected by cooperation of said second and first rotary convey means.

44. A sheet feeding apparatus according to claim 43, wherein said control means restricts rotation of said first rotary convey means when the load is small and rotates said first rotary convey means in a reverse rotational direction when the load is large.

45. A sheet feeding apparatus according to claim 44, wherein said control means comprises a torque limiter.

46. A sheet feeding apparatus according to claim 44, wherein the skew-feed of the sheet is corrected by forming a loop in the sheet between said second and first rotary convey means when the load is small and by registering a leading edge of the sheet with said second rotary convey means by rotating the skew-fed sheet between said second and first rotary convey means when the load is large.

* * * * *

UNITED STATES PATENT AND TRADEMARK OFFICE

CERTIFICATE OF CORRECTION

PATENT NO. 5,240,241

DATED August 31, 1993

INVENTOR(S) Kenji KAWAZOE

It is certified that error appears in the above-indentified patent and that said Letters Patent is hereby corrected as shown below:

Column 1
Line 25, "conconvenience'" should read --convenience'--.

Column 2
Line 67, "leading" should read --leading edge--.

Column 3
Line 52, "arose" should read --arises--.

Column 4
Line 18, "nip" should read --a nip--,
Line 35, "rotaty" should read --rotary--.

Column 8
Line 11, "occurs" should read --occur--,
Line 36, "in coaxial with" should read --coaxially with--,
Line 67, "Incondentally," should read --Incidentally,--.

Column 9
Line 16, "whereever" should read --wherever--.

Column 10
Line 38, "shaft portion 99b" should read --shaft portion 9b--.

Column 12
Line 6, "synchronous" should read --synchronism--,
Line 18, "supply core 13c" should read --supply core 13b--.

UNITED STATES PATENT AND TRADEMARK OFFICE

CERTIFICATE OF CORRECTION

PATENT NO. 5,240,241

DATED August 31, 1993

INVENTOR(S): Kenji KAWAZOE

It is certified that error appears in the above-indentified patent and that said Letters Patent is hereby corrected as shown below:

Column 13

Line 26, "disc driver 32" should read --disc drive 32--,
Line 27, "are" should read --area--,
Line 44, "disc driver 32," should read --disc drive 32,--,
Line 60, "disc driver 32" should read --disc drive 32--,
Line 61, "disc driver" should read --disc drive--.

Column 14

Line 67, "baring 9i," should read --bearing 9i,--.

Column 15

Line 45, "thre" should read --the--.

Column 16

Line 52, "to" should read --or--,
Line 66, "synchronous" should read --synchronism--.

Column 18

Line 26, "directions" should read --direction--,
Line 50, "supplied" should read --applied--, and "si" should read --is--,
Line 52, "int eh" should read --in the--.

Column 19

Line 23, "sheet supply" should read --feed--,
Line 24, "sheet supply" should read --feed--,
Line 66, "sheet" should read --feed--,
Line 67, "supply" should be deleted.

UNITED STATES PATENT AND TRADEMARK OFFICE

CERTIFICATE OF CORRECTION

PATENT NO. 5,240,241

DATED August 31, 1993

INVENTOR(S) Kenji KAWAZOE

It is certified that error appears in the above-indentified patent and that said Letters Patent is hereby corrected as shown below:

Column 20
Line 20, "a sheet" should read --the sheet--.

Column 21
Line 67, "load direction" should read --load directing--.

Column 22
Line 38, "cooperating" should read --cooperation--.

Column 24
Line 30, "convey" should read --convey means--.

Signed and Sealed this

Twenty-sixth Day of April, 1994

Bruce Lehman

*Attest:*

BRUCE LEHMAN

*Attesting Officer*

*Commissioner of Patents and Trademarks*